US006394571B1

(12) United States Patent
Yano et al.

(10) Patent No.: US 6,394,571 B1
(45) **Date of Patent: *May 28, 2002**

(54) METHOD AND APPARATUS FOR CONTROLLING PRINTING OPERATION WITH EXTERNALLY SUPPLIED PARAMETERS

(75) Inventors: Kentaro Yano; Naoji Ohtsuka, both of Yokohama; Nobuyuki Kuwabara, Kawasaki; Isao Ebisawa, Yokohama; Atsushi Arai; Hisao Yaegashi, both of Kawasaki; Toshiharu Inui, Yokohama; Kiichiro Takahashi; Osamu Iwasaki, both of Kawasaki; Daigoro Kanematsu, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/506,547

(22) Filed: Jul. 25, 1995

(30) Foreign Application Priority Data

Jul. 25, 1994 (JP) ..... 6-172613
Jul. 29, 1994 (JP) ..... 6-178288

(51) Int. Cl.[7] ..... B41J 29/38
(52) U.S. Cl. ..... 347/17
(58) Field of Search ..... 347/17, 14, 23, 347/5, 49, 59, 19, 191, 9; 395/115; 358/435, 436, 1.15

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,510,505 A * 4/1985 Fukui ..... 347/190
4,558,333 A 12/1985 Sugitani et al.
4,608,577 A 8/1986 Hori
4,723,129 A 2/1988 Endo et al.
4,740,796 A 4/1988 Endo et al.
4,872,027 A * 10/1989 Buskird et al. ..... 347/19
5,107,276 A * 4/1992 Kneelzel et al. ..... 347/14
5,359,358 A * 10/1994 Shimamura et al. ..... 347/9
5,502,475 A * 3/1996 Kaburagi et al. ..... 347/102
5,559,535 A * 9/1996 Otsuka et al. ..... 347/14
5,745,132 A * 4/1998 Hirabayashi et al. ..... 347/14
5,823,690 A * 10/1998 Narushima et al. ..... 347/17
5,956,052 A 9/1999 Udagawa et al. ..... 347/19

FOREIGN PATENT DOCUMENTS

JP 54056847 5/1979
JP 59123670 7/1984
JP 59138461 8/1984
JP 60071260 4/1985
JP 3-121872 5/1991
JP 4-86838 3/1992
JP 5-193127 8/1993
JP 5208505 8/1993

* cited by examiner

*Primary Examiner*—N. Le
*Assistant Examiner*—K. Feggins
(74) *Attorney, Agent, or Firm*—Fitzpatrick, Cella, Harper & Scinto

(57) ABSTRACT

A control portion for arithmetically predicting a temperature transition of a printing head using a predicting parameter includes an interface for receiving the predicting parameter from outside of the apparatus. The predicting parameter is based on a table regarding temperature increase of the printing head.

14 Claims, 26 Drawing Sheets

METHOD AND APPARATUS FOR CONTROLLING PRINTING OPERATION WITH EXTERNALLY SUPPLIED PARAMETERS

BACKGROUND OF THE INVENTION

1. Field of the Invention

The present invention relates generally to a printing apparatus. More specifically, the invention relates to a printing apparatus which can perform printing operation depending upon characteristics of a printing agent, such as an ink or so forth and components of the apparatus, such as a printing head and so forth to be employed in printing.

2. Description of the Related Art

In the recent years, owing to spreading of personal computers, wordprocessors, facsimiles and so forth in offices, various systems of printing apparatus have been developed as information outputting apparatus for these devices. Amongst these printing apparatus, an ink-jet type printing apparatus is suitable for personal use in the office or so forth for advantages of low printing noise, capability of high quality printing on various printing mediums, easiness of down-sizing and so forth. Among various ink-jet type printing apparatus, a construction, in which an ink-jet cartridge formed by integrating an ink tank storing an ink and a printing head converting an electric signal into a heat by a electrothermal transducer element and whereby causing film boiling in the ink for ejecting the ink by utilizing a pressure of bubble generated by boiling, is replaceably provided, is becomes a main current.

Such ink-jet cartridge permits shortening of an ink passage between the printing head and the ink tank. In this way, the ink-jet cartridge may lower production cost, and, as well, can reduce a consuming amount of the ink during suction recovery. In addition, when the ink in an amount to be used throughout the life of the printing head is stored in the ink tank, ink supply and maintenance of the printing head can be simultaneously done by replacement of the ink-jet cartridge by the user. Furthermore, the user may selectively use the ink-jet cartridges for color printing and monochrome printing. Such type of printing apparatus have been proposed.

Also, in view of significant expansion of the life of the printing head, there have been recently proposed printing apparatus which permit replacement of the printing head and the ink tank independently of each other.

In such printing apparatus, mainly for the purpose of improvement of printing quality, it have been becoming typical to preliminarily set a temperature management condition of the printing head and/or a head driving condition and so forth (these will be hereinafter generally referred to as "printing parameter") depending upon characteristics of a printing agent, such as the ink or so forth and apparatus components, such as the printing head and so forth.

One example of the printing parameter is a table data of temperature increase (rising) of the printing head to be used for detection of the temperature of the printing head. This table data is adapted to be used for arithmetically predicting variation of a head temperature on the basis of applied energy for the printing head. By controlling the energy to be applied on the basis of the predicted temperature, the temperature of the printing head can be controlled within a desired range, or ejection recovery process for the printing head can be controlled.

As one example of a method for predicting the head temperature, there is a method to perform calculation by adopting the behavior (increasing) of temperature of the printing head to a relatively precise physical formula of heat transmission. However, since the applied energy is sometimes varied depending upon the pattern to be printed, huge amount of process period and process capacity are required for performing arithmetic operation with adopting the temperature behavior to the physical formula set forth above.

Therefore, conventionally, the following method has been typically taken as an arithmetically predicting method of the head temperature. Namely, at first, the printing head which is constructed by assembling a plurality of components, is modeled as a composite body of a plurality of components having mutually different thermal time constant. Normally, the model is established with thermal time constant groups less than actual number of components by forming thermal time constant groups with approximately respective components to the group having the closest thermal time constant. Then, with respect to each modeled thermal time constant group, transition of temperature is calculated in discrete manner. The calculated values for respective thermal constant groups are accumulated to perform calculation of the temperature of the printing head. At this time, in order to reduce load on calculation of the temperature respect to each thermal time constant group, a table of data preliminarily calculated with respect to transition of temperature, is established in a form of two-dimensional matrix of a printing ratio (applied energy) per unit time for each of the thermal time constant groups and an elapsed time.

So-called open loop temperature control, in which temperature prediction as set forth above is performed, is advantageous in comparison with a closed-loop temperature control in which a temperature detection sensor is used, in response characteristics of detection of temperature, resistance against electrical noise and cost.

Another example of the printing parameter is data relating to an electric pulse for driving the printing head.

In general, the drive pulse (e.g. pulse of voltage) to be applied to the electrothermal transducing element in the ink-jet printing apparatus is set with mainly considering a physical property of the ink to be used, a heat generation amount per unit area at an ink contact surface of the electrothermal transducing element upon applying the pulse, and durability of the printing head against a stress in expansion and contraction due to heat.

On the other hand, in the ink-jet printing apparatus, as one of a method for realizing high printing quality, a construction for controlling the drive pulse to be applied depending upon the temperature of the printing head. Generally, this is because that when the temperature of the printing head, i.e. the temperature of the ink to be ejected, is varied, the ejection amount of the ink is varied according to temperature variation, and thus, if the drive pulse is fixed, the ejection amount is varied due to variation of the head temperature depending upon accumulation of heat during printing, or so forth to cause fluctuation of density of the printed image.

The setting data of the drive pulse and the control data of the drive pulse detecting upon the temperature as set forth above are preliminarily set and stored in a memory, such as ROM and so forth.

However, since the printing parameter is preliminarily set in production of the apparatus and so forth, as set forth above, the problems discussed hereinafter may be encountered.

The printing parameter, such as the head drive data and so forth, is set corresponding to the characteristics of the printing head and the printing ink upon putting the printing apparatus into market. Therefore, when superior quality of printing head and/or the printing ink which are the primary technology in the ink-jet printing apparatus, are developed through innovative activities and when such superior quality of printing head and/or the printing ink are applicable for the printing apparatus which have already been in the market, the table for predicting temperature and head drive data which are preliminarily set and stored in the existing printing apparatus cannot always be suitable for such newly developed printing head and/or the printing ink. Therefore, the user employing the prior marketed printing apparatus may not use the newly developed printing head and/or the printing ink at the optimal drive condition. In other words, such incompatibility of the printing parameter may be a constraint in application of the newly developed printing ink and/or the printing head and so forth in the printing apparatus having older specification.

In particular, in case of the printing apparatus which is replaceably use the printing head and the ink tank as set forth above, improvement of the quality for the printing head and so forth independently of others is easy. Therefore, the above-mentioned problem becomes significant.

As one of the solutions for the above-mentioned problem, it has been known a construction, in which a memory, such as a ROM is provided for each individual ink-jet cartridge and the drive condition and so forth is stored with respect to each of individual cartridge. According to such construction, it is allowed to drive the printing head in an optimal condition with respect to each individual ink jet cartridge, and the above-mentioned problem can be solved at least. Employing such ROM in the printing cartridge which is consumables, however, gives rise to increasing of the cost of the products. Therefore, the conventional printing apparatus has been desired to be improved in view of these points.

SUMMARY OF THE INVENTION

It is an object of the present invention to provide a printing apparatus which can appropriately set a printing parameter depending upon modification of specification of a printing ink and/or a printing head and so forth.

Another object of the present invention is to provide a printing apparatus which can perform open loop control for a temperature of the printing head without being affected by external disturbance, such as delay in response or noise, at low cost and with high precision and high speed, and can cope with version-up of consumables, such as the printing ink, the printing head and so forth, without an increase of the cost of the products.

A further object of the present invention is to provide a printing apparatus which can set a driving condition corresponding to version-up of the printing head to a main body of the printing apparatus.

In a first aspect of the present invention, there is provided a printing apparatus performing printing on a printing medium by using a printing head, comprising:

an input means for externally inputting a printing parameter to the printing apparatus, the printing parameter being determined depending upon characteristics of at least a part of elements and being used for control of operation of the printing apparatus; and a control means for performing control for the operation using the printing parameter input by the input means.

In a second aspect of the present invention, there is provided a printing method for performing printing on a printing medium by using a printing head, comprising the steps of:

inputting a printing parameter, the printing parameter being determined depending upon characteristics of at least a part of elements and being used for control of operation of the printing; and performing control for the operation using the printing parameter input by the step for inputting.

In a third aspect of the present invention, there is provided a method for arithmetically predicting a temperature of a printing head for predicting a temperature transition of the printing head employing an arithmetic prediction parameter, comprising the step of:

taking the arithmetic prediction parameter from out side of an apparatus employing the printing head.

In a fourth aspect of the present invention, there is provided a printing method for performing printing by applying a drive pulse to a printing element of a printing head on the basis of a driving parameter, comprising the step of:

taking at least a part of the driving parameter from out side of an apparatus employing the printing head.

In a fifth aspect of the present invention, there is provided a system comprising:

a printing apparatus performing printing on a printing medium by using of a printing head; including:

an input means for externally inputting a printing parameter to the printing apparatus, the printing parameter being determined depending upon characteristics of at least a part of elements and being used for control of operation of the printing apparatus; and a control means for performing control for the operation using the printing parameter input by the input means; and an external apparatus inputting the printing parameter through the input means.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF PREFERRED EMBODIMENTS

The preferred embodiments of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

FIGS. 1 to 6 are explanatory illustrations explaining respective of preferred ink-jet unit IJU, an ink-jet head IJH, an ink tank IT, an ink-jet cartridge IJC, a main body of ink-jet printing apparatus IJRA and a carriage HC, and relationship between respective components. Hereinafter, discussion will be given for construction of each component with reference to the drawings.

(i) Brief Explanation of Main Body of Apparatus

Figure 1:
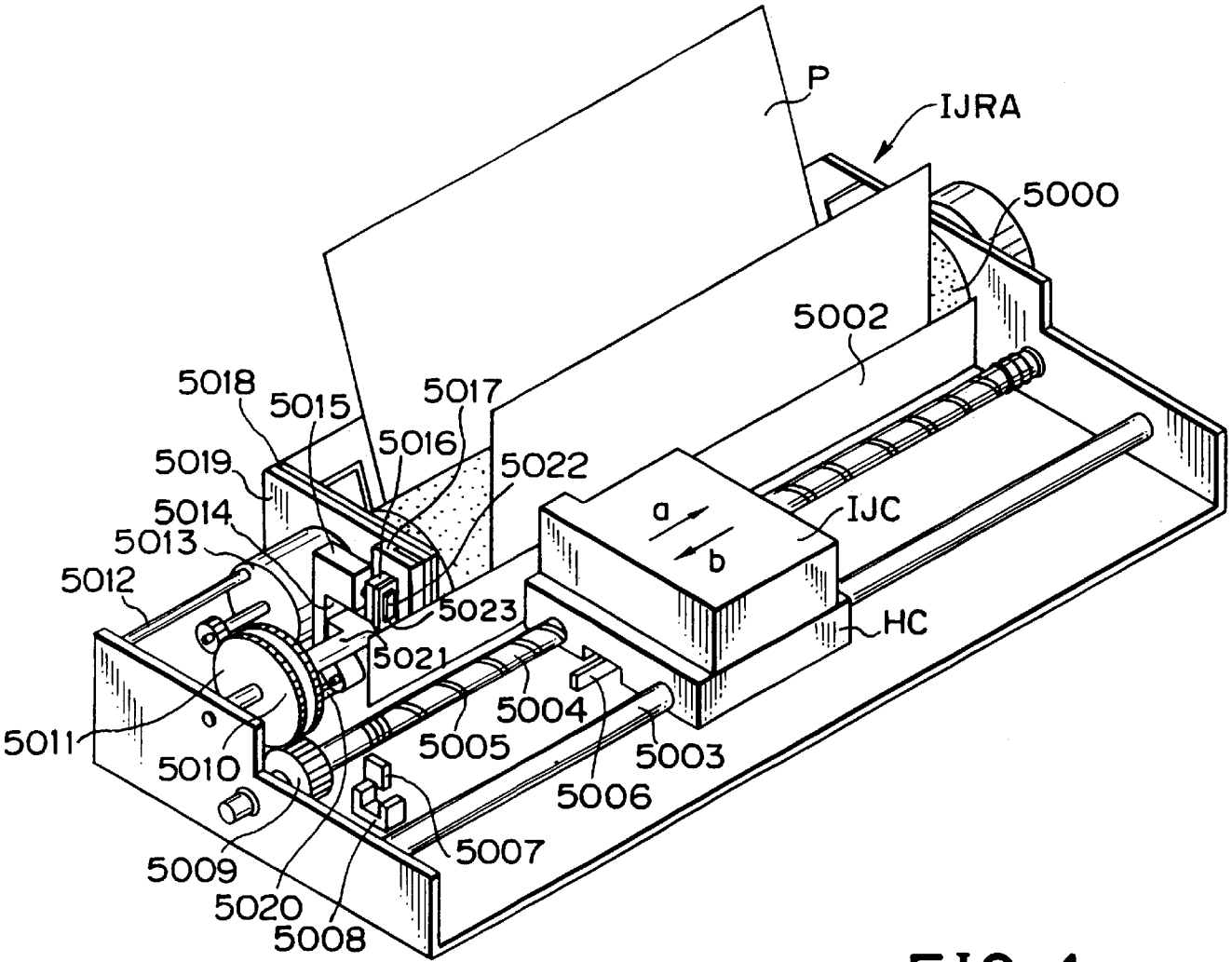
FIG. 1 is a perspective view showing a construction of an ink-jet printing apparatus suitable for implementing the present invention.

FIG. 1 is a fragmentary illustration of an ink-jet printing apparatus IJRA, in which the present invention is implemented. In FIG. 1, a carriage HC engaging with a spiral groove 5004 of a lead screw 5005 rotating via a drive force transmission gears 5011 and 5009 associating with forward and reverse rotation of the drive motor 5013, has a pin (not shown) and is reciprocally moved in directions of arrows a and b. On the carriage HC, an ink-jet cartridge IJC is mounted. A paper holder 5002 depresses a paper P onto a platen 5000 over a moving direction of the carriage. Photo couplers 5007 and 5008 detect presence of a lever 5006 of the carriage within regions where they are provided. The photo couplers 5007 and 5008 thus serves as home position detecting means for switching driving direction of a motor 5013. A supporting member 5016 is a member for supporting a cap member 5022 for capping the front face of the printing head. A suction means 5015 for sucking in the cap member performs suction recovery of the printing head via an opening 5023 in the cap. A cleaning blade 5017 is provided on a moving member 5019 and movable in back and forth direction. The moving member 5019 is supported on a support plate 5018 of the main body. Needless to say, in place of the shown form of the cleaning blade 5017, known cleaning blades are applicable for the shown embodiment.

On the other hand, a lever 5021 is for initiating suction for suction recovery and moves according to movement of a cam 5020 engaging with the carriage HC, so that the drive force from a drive motor is transmitted via a known transmission means, such as a clutch switching and so forth and a suction recovery operation is controlled.

These capping, cleaning and suction recovery are so constructed as to perform desired process at respective corresponding positions by the effect of the lead screw 5005 when the carriage is placed at the region of the home position side. However, by constructing to perform desired operation at known timings, any construction may be applicable for the shown embodiment.

Figure 2:
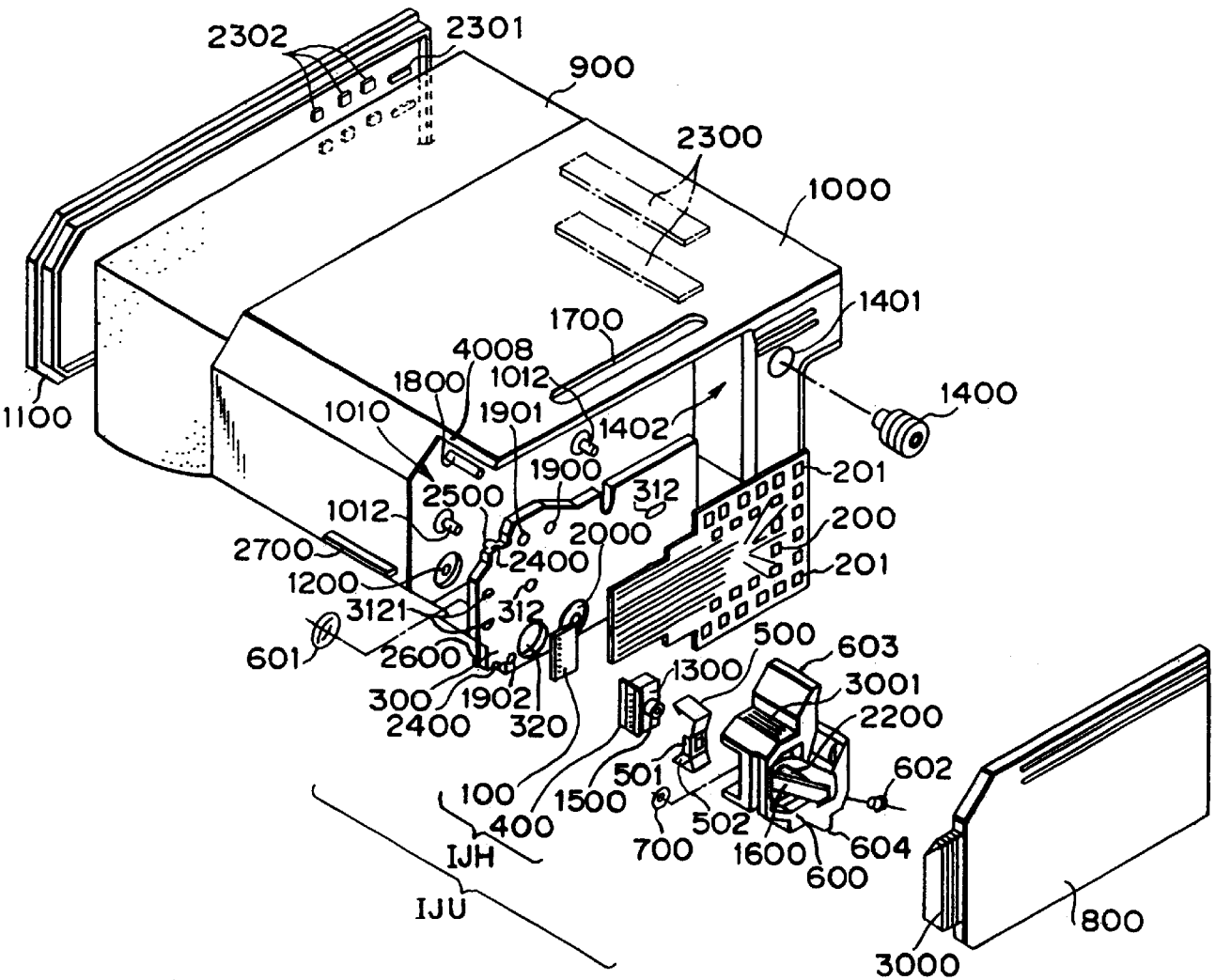
FIG. 2 is a perspective view showing a replaceable ink-jet cartridge to be employed in the ink-jet printing apparatus of FIG. 1.

The ink cartridge IJC of the shown embodiment has greater ratio of ink storage, as clear from a perspective view of FIG. 2, and has a configuration slightly projecting the tip end of the ink-jet unit IJU from the front face of the ink tank IT. The ink-jet cartridge IJC is fixedly supported by a positioning means of the carriage HC (FIG. 1) mounted on the main body of the ink-jet printing apparatus IJRA discussed later and an electric contact, and is a type detachable with respect to the carriage HC.

(ii) Explanation of Construction of Ink-Jet Unit IJU

The ink-jet unit IJU is a unit of the type which performs printing employing an electrothermal transducer generating a heat energy for causing film boiling of the ink depending upon the electric signal.

In FIG. 2, a heater board 100 has the electrothermal transducers (ejection heaters) arranged in a plurality of rows and generating heat energy, and an electric wiring, such as Al and so forth for supplying an electric power for the electrothermal transducers, formed on a Si substrate, by a deposition technology. A wiring board 200 has a wiring corresponding to the wiring of the heater board 100 (connected by wiring bonding, for example) and a pad 201 positioned at the end of wiring and receiving an electric signal from the main body of the apparatus. A ceiling plate 1300 has partitioning walls forming ink passages respectively corresponding to a plurality of ink ejection orifices and a common liquid chamber. Also, the ceiling plate 1300 is integrally provided with an ink receptacle opening 1500 and an orifice plate 400 having a plurality of ejection orifices. The partitioning walls provided in the ceiling late 1300 are integrally formed with the ceiling plate. As a material for integrally forming the ceiling plate and the partitioning walls, polysulfone is preferred. However, other resin material for forming may also be employed.

A support body 300 supports the wiring board 200 on a plain, and is formed with a metal for forming a constructional member of the printing head unit. A holding spring 500 has a substantially M-shaped cross section. The holding spring 500 biases the portion corresponding to the common liquid chamber of the ceiling plate 1300 with the center portion in M-shaped holding spring. Similarly, a front droop portion 501 of the holding spring biases in line contact for the portion corresponding to the ink or liquid passages of the ceiling plate 1300. By engaging the leg portions 502 of the holding spring 500 to the back surface side of the support body 300 through openings 3121 of the support body 302, the holding spring 500 clamps the heater board 100 and the ceiling plate 1300 between the support body 300. Thus, with the resilient biasing force of the holding spring 500 and its front droop portion 501, the heater board 100 and the ceiling plate 1300 can be fixedly fitted to the support body 300. The support body 300 has respectively to positioning holes 312 and 1900 respectively engaging with two positioning projections 1012 and with two positioning and thermal welding holding projections 1800 provided on the ink tank. Also, the support body 300 has projections 2500 and 2600 on the back surface side with respect to the carriage of head cartridge at the side of the main body of the apparatus. In addition, the support body 300 has a hole 320, through which an ink supply tube 2200 (discussed later) can extend, for permitting supply of ink from the ink tank. Mounting of the wiring board 200 relative to the support body 300, is performed by bonding with a bond and so forth.

Recessed portions 2400, 2400 of the support body 300 are provided in the vicinity of the projections 2500 and 2600 for positioning. These recessed portions are positioned at extension points of a plurality of parallel grooves 3000 and 3001 formed on three circumferential edges of the printing head unit IJU for avoiding unnecessary substances, such as dust, ink and so forth to reach the projections 2500 and 2600. As can be seen from FIG. 14, a lid portion 800 formed in the parallel grooves 3000 are formed on the outer wall of the head cartridge, and forms a portion for housing the printing head unit IJU. An ink supply passage member 600 formed with the parallel grooves 3001 has an ink conduit 1600 passing the ink by connection with an ink supply tube 2200, in cantilever fashion fixed at the connection side of the supply tube 2200. On the other hand, at the fixed portion of the ink conduit 1600, the ink supply passage member 600 has a seal pin 602 for certainly providing capillary effect with the ink supply tube 2200. It should be noted that a packing for performing coupling seal with the supply tube 2200 for the ink tank is provided, and 700 denotes a filter provided at the end portion at the side of the tank of the supply tube 2200.

The ink supply passage member 600 is formed by molding and thus can formed with high position precision at low cost. Also, by cantilever construction of the conduit 1600, pressure fitting condition of the conduit 1600 to the receptacle opening 1500 of the ceiling plate 1300 can be made stable. In the shown embodiment, under the press fitted condition, a sealing bond is funneled from the side of the ink supply passage member.

It should be noted that fixing of the ink supply passage member 600 to the support body 300 can be easily done by passing pins (not shown) on the back side of the ink supply passage member 600 opposing to the holes 1901 and 1902 of the support body 300, through the holes 1901 and 1902, and by thermal welding of the portions of the pins projecting to the back surface side. It should be appreciated that the slightly projecting region at the back surface portion due to thermal welding can be received within recesses (not shown) on the wall surface at the side of the printing head unit IJU mounting surface. Therefore, the accurate positioning surface of the unit IJU can be obtained.

(iii) Explanation of Construction of Ink Tank IT

The ink tank comprises a cartridge main body 1000, an ink absorbing body 900, and a lid 1100 for sealing after insertion of the cartridge main body 1000 from the opposite side to the unit IJU mounting surface. The absorbing body 900 is arranged within the cartridge body 1000. A supply opening 1200 is a supply opening for supplying the ink fir the unit IJU formed with respective portions 100 to 600. The supply opening 1200 also serves as ejection orifice for impregnating the ink for the absorbing body by injecting the ink therethrough in a step before arranging the unit at the portion 1010 of the cartridge main body 1000. In the shown embodiment of the head cartridge, the portion permitting injection of the ink into the ink tank is an opening 1401 opening to the atmosphere and the supply opening 1200. However, by providing an air presenting region within a tank defined by a rib 2300 formed on the side surface in the main body 1000 and ribs 2301 and 2302 formed on the inner side surface of the lid 1100 at the portion continuous to the atmosphere communicating opening 1401, and by extending the air presenting region at the cover region the most distant from the ink supply opening, good ink supply characteristics from the ink absorbing body is maintained. Therefore, it is important that good and uniform ink injection to the absorbing body is performed through the supply opening 1200. This method is practically quite effective. The rib 2300 includes four ribs (only two are shown on the upper surface of FIG. 3) in parallel to the moving direction of the carriage to prevent the absorbing body from being tightly fitted onto the surface of the main body 1000. On the other hand, while the partial ribs 2301 and 2302 are provided on the inner side surface of the lid 1100 at the location on the extensions of the ribs 2300. However, they are in a form separated from each other differently from the rib 2300. By this, the space where the air is present, can be increased from the former. It should be noted that the ribs 2301 and 2302 are distributed on the surface less than half of the overall area of the leg 1100. By these ribs, it becomes possible to further stabilize the ink in the region the most distant from the tank supply opening 1200 of the ink absorbing body 900, and can certainly introduce into the supply opening side by the capillary force. 1401 denotes an atmosphere communication opening provided in the lid for establishing communication between the interior space of the ink tank. 1400 denotes a liquid repellent agent arranged at the inside of the atmosphere communicating opening 1401 to prevent leakage of ink through the atmosphere communicating opening 1401.

An ink receptacle space of the ink tank is in a rectangular parallelpiped configuration and has longer edges at the side. With respect to such configuration of ink tank, the arrangement of the ribs as set forth above is particularly effective. However, in case that the longer edges are oriented in the moving direction of the carriage or in the case where the ink tank is in cubic configuration, ink supply from the ink absorbing body can be stabilized by provided the rib on the overall portion of the lid 1100.

Figure 4:
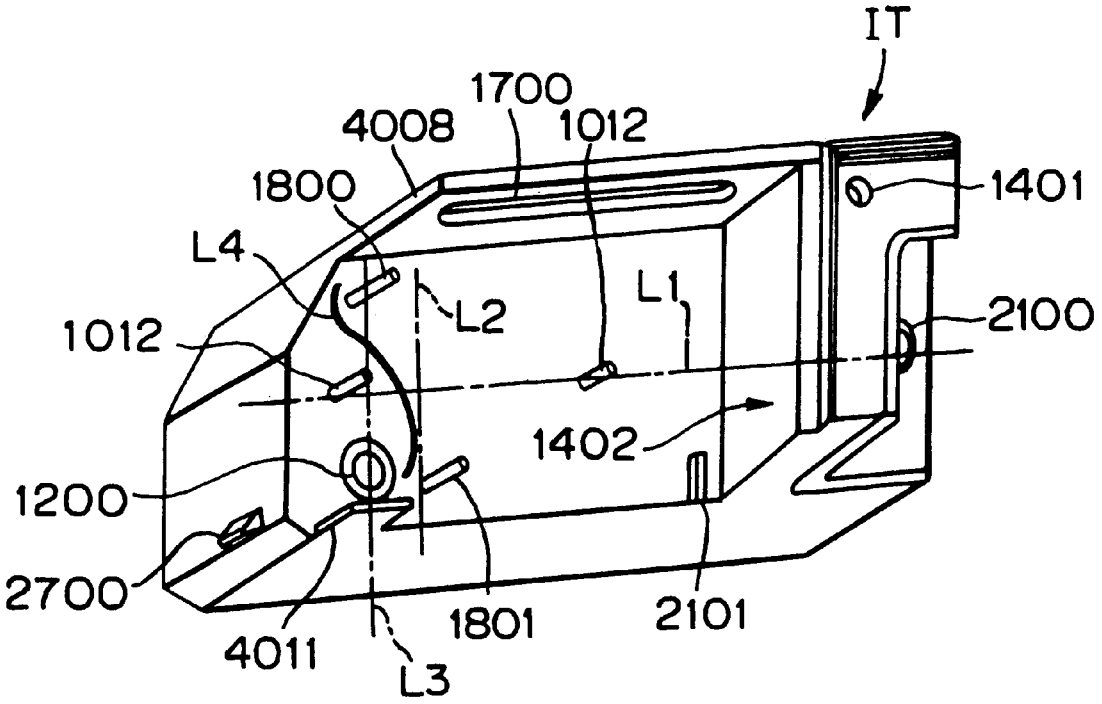
FIG. 4 is a perspective view showing an engaging portion in the ink-jet cartridge engaging with a printing head of an ink tank.

The construction of the surface of the ink tank IT to mount the unit IJU is shown in FIG. 4. A line extending through substantial center of rows of ejection orifices of the orifice plate 400 and parallel to the bottom surface of the ink tank IT or a mounting reference surface of the surface of the carriage is assumed as L1. Then, two positioning projections 1012 engaging with the holes 312 of the support body 300 lie on this line L1. The height of the projection 1012 is slightly lower than the thickness of the support body 300. By engagement of these projections 1012 with the holes 312, the support body 300 can be positioned. On the extension of the line L1 on the drawing, a claw 2100 engaging with a vertical engaging face 4002 of a positioning hook 4001 for the carriage is positioned. An operational force for positioning of the carriage may act on a surface region parallel to the reference surface including the line L1. While it will be discussed later with reference to FIG. 5, these relationship is effective in construction since the precision in positioning of the ink tank relative to the carriage becomes equal to the precision in positioning of the ejection orifices of the printing head relative to the carriage.

On the other hand, the projections 1800 and 1801 corresponding to fixing holes 1900 and 2000 for fixing of the ink tank side surface of the support body 300 are longer than the projection 1012 set forth above. By this, the projections 1800 and 180*a* of the ink tank may extend through the support body 300 for fixing the support body 300 on the side surface of the ink tank by thermal welding of the extended portions. Assuming a line extending perpendicular to the line L1 through the projection 1800 is L3, and a line extending perpendicular to the line L1 through the projection 1801 is L2, the center of the supply opening 1200 of the ink tank is substantially placed on the line L3. Therefore, it serves for stabilizing coupling condition between the supply opening 1200 and the supply tube 2200 and can reduce load against coupling condition of these elements upon falling down or exertion of impact. Thus the shown construction is preferred. On the other hand, since the lines L2 and L3 are not consistent with each other, and the projections 1800 and 1801 are present around the projection 1012 at the side of the ejection orifices of the printing head among two projections 1012, 1012, the positioning effect of the printing head relative to the ink tank can be further enhanced. It should be noted that a curve L4 represents the position of the external wall when the ink supply passage member 600 is installed. Since the projections 1800 and 1801 are located along this curve L4, sufficient strength and positioning precision are provided in relation to the weight of the construction at the tip end side of the printing head. It should be noted that the reference numeral 2700 denotes an extension strip of the ink tank It, which is adapted to be inserted into a slot in a front plate 4000 of the carriage for abnormality, in which displacement of the ink tank becomes extraordinarily bad.

By the ink tank and a lid 800 which covers the unit IJU after installation of the unit IJU on the ink tank, the unit IJU is surrounded except for the lower opening. However, the head cartridge is installed on the carriage of the main body of the apparatus, and, at this time, the lower opening is placed in the vicinity of the carriage, a surrounding space substantially surrounding the ink tank is formed. Accordingly, heat from the printing head IJH placed within the surrounded space is dispersed within the space to effectively maintain the temperature in the space uniform. However, on the other hand, when the head IJH is driven continuously for a long period and so forth, it is possible to cause slight temperature increase. Therefore, in the shown embodiment, a slit 1700 having smaller width than the space is provided at the upper side of the cartridge for preventing natural heat radiation through the support body 300 to avoid influence of the environment for uniformity of temperature distribution in ovarial unit IJU with preventing increase of temperature.

Figure 3:
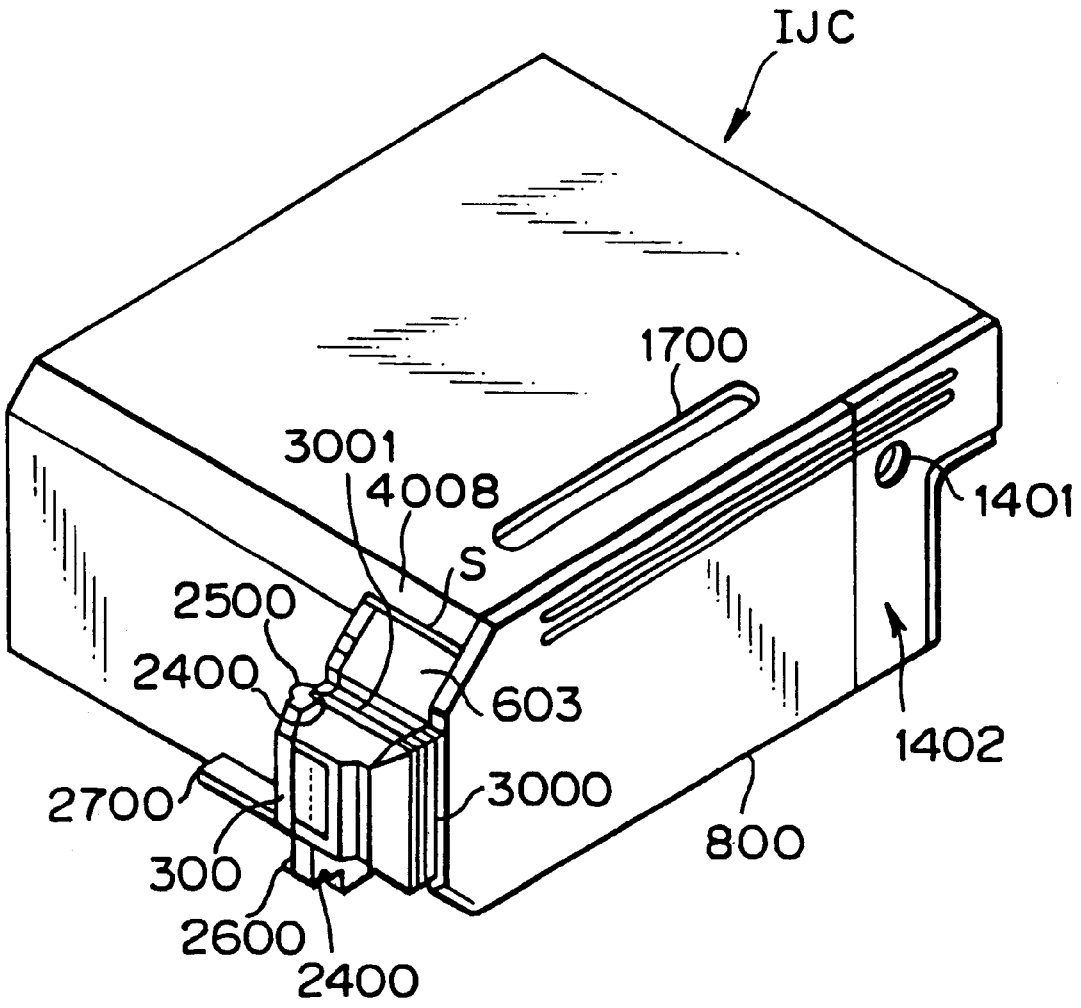
FIG. 3 is a perspective view showing the ink-jet cartridge.

As shown in FIG. 3, when assembled as the head cartridge IJC, the ink is introduced into the conduit 1600 from the supply opening 1200 of the ink tank through a hole 320 provided in the support body 300 and a supply tube 2200 arranged through the inlet opening provided at the back surface side of the supply tank 600, and then flows into the common liquid chamber after flowing inside and then through an ink induction opening 1500 of the ceiling 1300. At the connecting portion of the supply tube and the conduit, a packing, such as that made of silicon rubber, butyl rubber and so forth, is provided for sealing to certainly establish the ink supply passage.

It should be noted that, in the shown embodiment, the ceiling 1300 is formed integrally and simultaneously with the orifice plate 400 by molding utilizing a resin, such as polysulfone, polyethersulfone, polyphenylene oxide, polypropylene and so forth.

As set forth, the ink supply passage member 600, the ceiling and orifice plate assembly and the ink tank main body 1000 are respectively formed as integrally molded parts. Therefore, precision in assembling becomes high level. Also, such integral molding is quite effective in improvement of quality in mass production. Furthermore, since number of parts can be reduced in comparison with that in the prior art, desired characteristics can be certainly attained.

(iv) Explanation for Mounting of Ink-jet Cartridge IJC to Carriage HC

Figure 5:
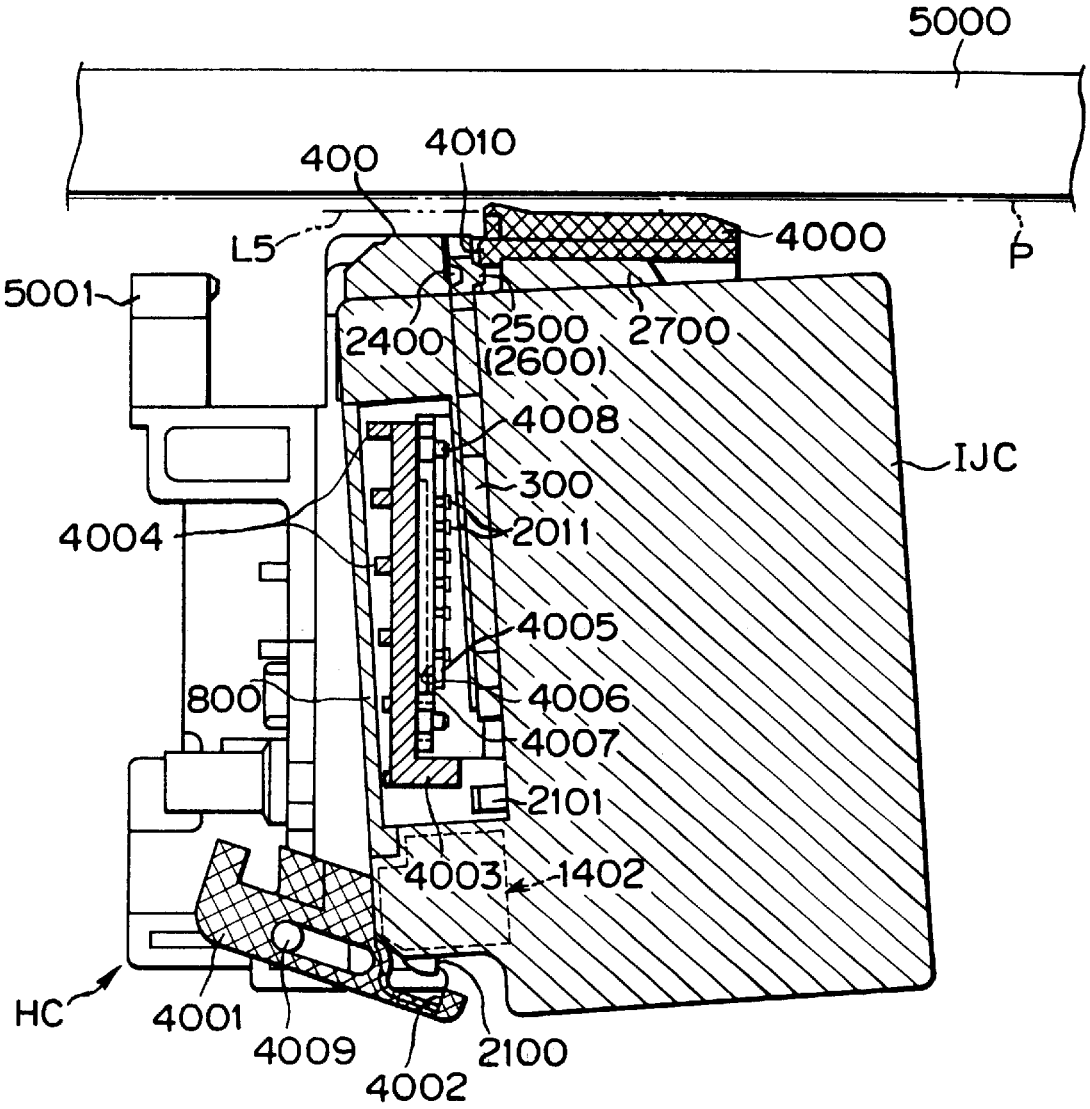
FIG. 5 is an illustration showing manner of mounting of the ink-jet cartridge onto a carrier.

In FIG. 5, the reference numeral 5000 denotes a platen roller which drives a printing medium P from the lower side to the upper side of the drawing according to its rotation by the effect of friction force. The carriage HC is provided for movement along the platen roller 5000. At the front side of the head cartridge IJC located at the side of the platen, the front plate 4000 (2 mm in thickness) is provided. On the other hand, on the carriage, a support plate 4003 for an electrically connecting portion, having a flexible sheet 4005 with pads 2011 corresponding to the pad 201 of the wiring board 200 of the cartridge IJC and a rubber pad 4006 having an elastic force for biasing the flexible sheet onto respective pads 2011 from the back surface side, and a positioning hook 4001 for fixing the ink cartridge IJC at the printing position, are provided. The front plate 400 has two positioning projecting faces 4010 corresponding to the positioning projections 2500 and 2600 of the support body 300 set forth above, for bearing vertical force toward the projecting faces 4010 after installation of the cartridge. Therefore, a reinforcement rib is provided on the front plate 4000 at the side of the platen roller, and a plurality of ribs (not shown) oriented toward the direction of the vertical force are provided. These ribs forms a head protecting projecting portions which are slightly (approximately 1 mm) projecting toward the platen roller 5000 beyond the front surface position (shown by L5 in the drawings) upon installation of the cartridge. The support plate 4003 for electric connecting portion has a plurality of reinforcement ribs 4004 extending in the direction perpendicular to the sheet of the drawing, and has a descending thickness from the side of the platen roller to the side of the hook in the direction parallel to the platen roller 5000. This serves to tilt the position to install the cartridge. Also, for stabilizing electrically connected condition, the support plate 4003 has a positioning surface 4008 at the side of the platen roller and the positioning surface 4007 at the hook side to define therebetween a pad contact region and to fixedly define a deformation magnitude of a rubber sheet 4006 with projections corresponding to pads 2011, respectively. These positioning surfaces comes into contact with the surface of the wiring board 200 when the cartridge IJC is fixed at the position capable of printing. In the shown embodiment, since the pads 201 of the wiring board 200 is distributed to be symmetric relative to the line L1, the deformation magnitude of the projections of the rubber sheet 4006 can be made uniform for stabilizing contact pressure between the pads 2011 and 201. The distribution of the pads 201 in the shown embodiment are upper and lower two rows and vertically two columns.

The hook 4001 has an elongated hole engaging with a fixed shaft 4009 for performing positioning associating with installation of the ink-jet cartridge IJC relative to a carriage HC by shifting toward left in parallel to the platen roller 5000 after pivoting in the counterclockwise direction from the shown position utilizing a space of motion in the elongated hole. While motion of the hook 4001 may be caused in various ways, it is preferred to have a construction to actuate the hook 4001 by means of a lever and so forth. In any case, during pivotal movement of the hook 4001, the cartridge IJC moves toward the platen roller and thus moves the positioning projections 2500 and 2600 the position capable of contacting with the positioning surface 4010 of the front plate. Furthermore, by further movement of the hook 4001 toward left, the vertical hooking surface 4002 is held at the fixed position. Thus, the complete contact condition between the pads 2011 and 201, complete surface contact between the positioning surfaces 2500 and 4010, two surfaces contact between the vertical surface 4002 and the vertical surface of the claw, and the surface contact between the wiring board 300 and the positioning surfaces 4007 and 4008 are established simultaneously. By this, installation of the cartridge IJC to the carriage is completed.

(v) Explanation of Heater Board

Figure 6:
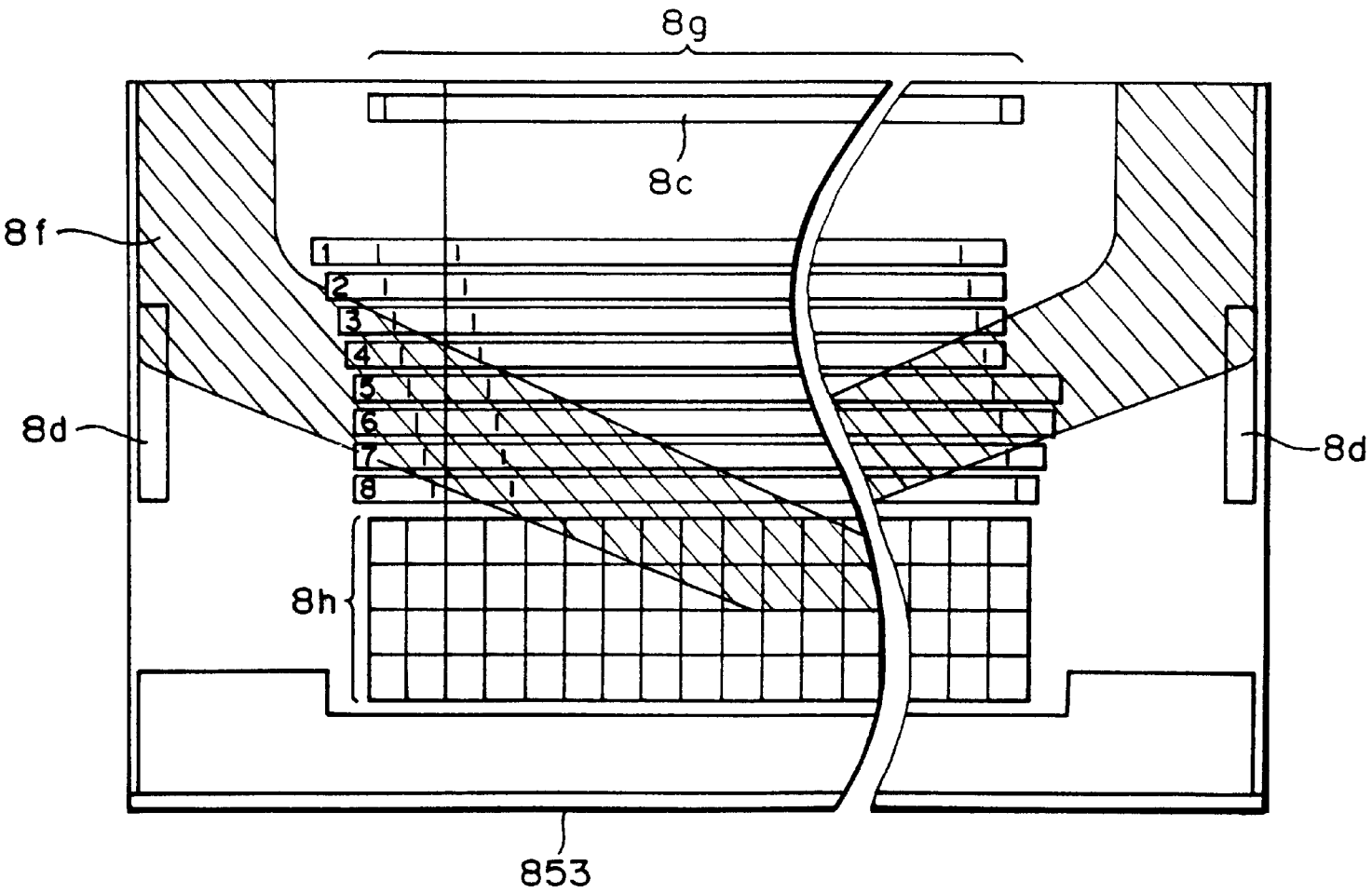
FIG. 6 PRIOR ART
FIG. 6 is an illustration showing a relationship in position between an ejection heater and a sub-heater in a heater board of the printing head.

FIG. 6 is a diagrammatic plane view of the heater board 100 of the printing head employed on the shown embodiment. An ejecting portion array 8*g*, in which a temperature controlling (sub) heater 8*d* for controlling temperature of the head and an ejection (main) heater 8*c* for ejecting ink, and a drive element 8*h* are formed on a common substrate with the positional relationship as illustrated. By arranging respective elements on the common substrate, detection of the temperature of the head and control thereof can be efficiently performed. Also, by the arrangement as shown, production process can be simplified. Also, in FIG. 6, a positional relationship between the heater board and a section of a circumferential wall 8*f* of the ceiling plate which separates a region where the heater board is filled with the ink and a region not filled with the ink. At the side of the ejection heater 8*d* of the circumferential wall section 8*f* of the ceiling, serves as the common liquid chamber. It should be noted that the liquid passage is defined by groove portions of the circumferential wall section 8*f* formed above the ejecting portion array 8*g*.

Several embodiments of the present invention which can be implemented by the ink-jet printing apparatus set forth above will be discussed hereinafter.

(First Embodiment)

The shown embodiment is directed to a construction, in which a temperature increase table data of a head model can be set as the printing parameter which is used for a predicting calculation of the temperature of the printing head.

Modeling of Printing Head

Detection of the temperature of the printing head in the shown embodiment is performed with an arithmetic predicting means based on physical formula of heat conduction. However, as set forth above, since huge amount of process is required in arithmetic prediction, in the shown embodiments, a plurality of models of thermal time constant groups in heat conduction within a range which may not cause substantially problem in handling as equivalents are established for the printing head. Then, with respect to each thermal time constant, temperature transition is arithmetically predicted by means of a table.

Hereinafter, detailed discussion will be given for divided modeling dividing the components of the printing head into the groups having substantially the same or equivalent thermal time constant.

By applying a given electric energy to the printing head, data relating to the temperature of the printing head in the elapsed time was sampled. Then, the result as illustrated in FIG. 7 was obtained.

An actual printing head consists of many members which are different in the thermal time constant from each other. In respective ranges in which a differential coefficient of temperature increase data after a logarismic transformation with respect to elapsed time shown in FIG. 7 is constant, that is, in respective ranges A, B and C in which slopes of lines are constant, respectively as shown in FIG. 7, the printing head can be treated as a single member with respect to heat conduction. Namely, with taking each of those which can be handled as individual heat conduction members, as a unit, transition of the temperature of the printing head can be predicted by deriving behavior of variation of the temperature in respective units.

From the result of the above discussion, it is assumed, in the modeling relating to the heat conduction in the shown embodiment that the printing head can be handled with two thermal time constants. While it is shown in the results shown in FIG. 7, that modeling having three thermal time constants will more precisely reflects behavior in temperature of the printing head, under judgement that the gradients in the areas B and C are substantially equal, and by giving higher preference in efficiency of detection, the shown embodiment establishes a model of the printing head with two thermal time constants.

Figure 7:
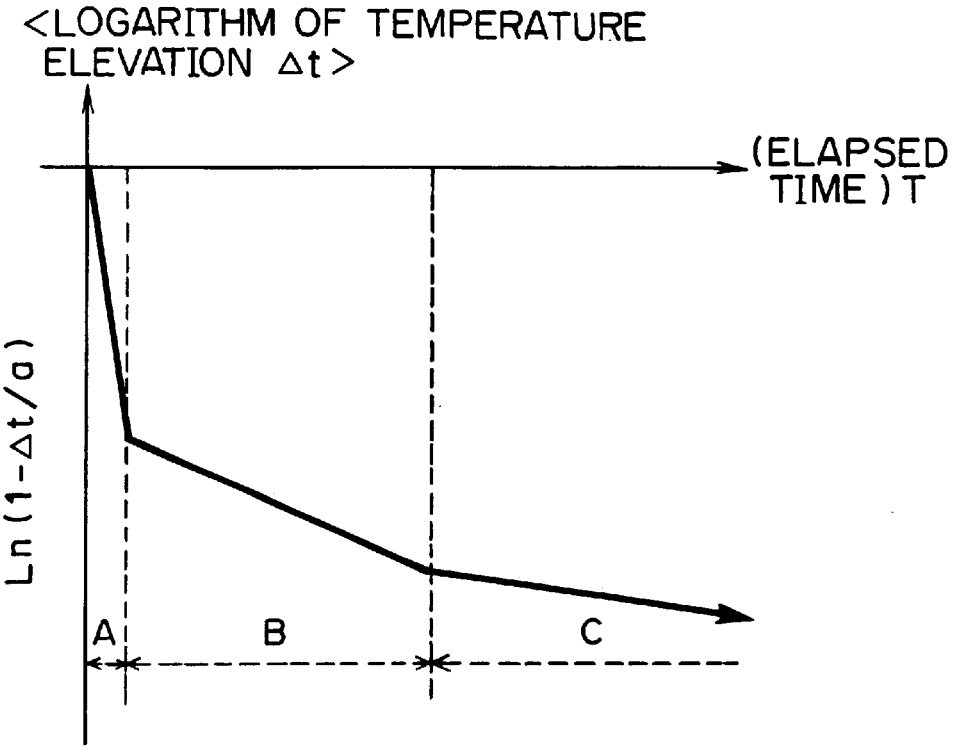
FIG. 7 is an illustration showing a temperature increasing process of the printing head, for which the present invention is applied.

In concrete, one heat conduction is a modeling of the components having a time constant for increasing the temperature to an equilibrium temperature at 0.8 seconds (corresponding to the region of A in FIG. 7), and the other is a modeling of the components having a time constant for increasing the temperature to an equilibrium temperature at 512 seconds (corresponding to the regions B and C of FIG. 7). Hereinafter, the group of the components aggregated in the range A will be referred to as "short range time constant group", and the group of components aggregated in the ranges B and C will be referred to as "long range time constant group".

Figure 8:
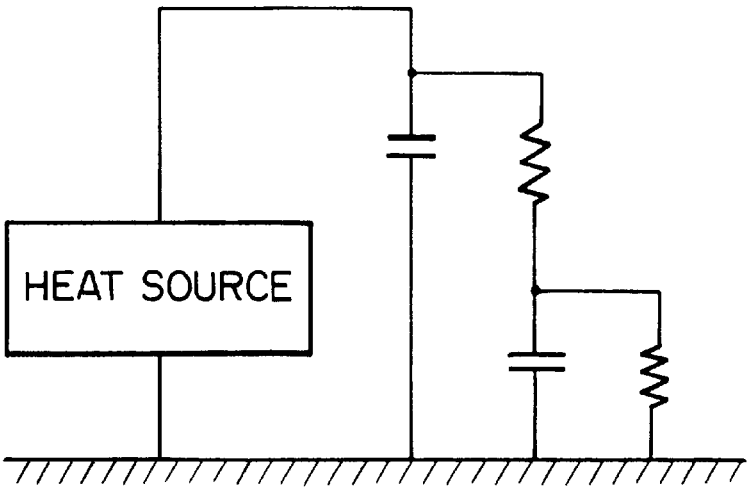
FIG. 8 is an illustration showing an equivalent circuit of a thermal conduction of a modeled printing head in the shown embodiment.

FIG. 8 shows an equivalent circuit for heat conduction in the printing head modeled by the shown embodiment.

Calculation of Temperature Transition per Time Constant Group

Next, physical formula of temperature conduction for predicting the temperature for each time constant group of the printing head utilizing the shown embodiment.

Upon Heating $$\Delta\text{temp}=a\{1-\exp[-m\times T]\} \quad (1)$$

Cooling from Midway of Heating $$\text{temp}=a\{\exp[-m(T-T_1)]-\exp[-m\times T]\} \quad (2)$$

wherein temp: temperature increase of substance;

a: equilibrium temperature of substance depending by heat source;

T: elapsed time;

m: thermal time constant of substance;

$T_1$: timing of removal of heat source.

ON/OFF of the ejection heater as the heat source is caused at a frequency corresponding to a drive frequency of the printing head, in the printing apparatus. In the shown embodiment, a unit time discussed later is provided so that the temperature is calculated from an applied energy per the unit period. Also, in the shown embodiment, by employing a calculation algorithm developing the foregoing physical formula to the following to reduce load in arithmetic process.

<Ex. Prediction of Temperature After Exploration of nt Period After Turning ON of Heat Source>

$$
\begin{aligned}
a\{1-\exp[-m\times n\times t]\} &= a\{\exp[-m\times t]-\exp[-m\times t]+ \\
&\quad \exp[-2\times m\times t]-\exp[-2\times m\times t]+\ldots+ \\
&\quad \exp[-(n-1)\times m\times t]-\exp[-(n-1)\times m\times t]+ \\
&\quad 1-\exp[-n\times m\times t]\} \qquad \langle 1\rangle \\
&= 1\{1-\exp[-m\times t]\}+a\{\exp[-m\times t]- \\
&\quad \exp[-2\times m\times t]\}+a\{\exp[-2\times m\times t]- \\
&\quad \exp[-3\times m\times t]\}\ldots+a\{\exp[-(n-1)\times m\times t]- \\
&\quad \exp[-n\times m\times t]\} \\
&= a(1-\exp[-mt]\} \qquad \langle 2\text{-}1\rangle \\
&\quad +a\{\exp[-m\times(2t-t)]-\exp[-m\times 2t]\} \qquad \langle 2\text{-}2\rangle \\
&\quad +a\{\exp[-m\times(3t-t)]-\exp[-m\times 3t]\} \qquad \langle 2\text{-}3\rangle \\
&\quad +a\{\exp[-m\times(nt-t)]-\exp[-m\times nt]\} \qquad \langle 2\text{-}n\rangle
\end{aligned}
$$

By development as set forth above, the formula <1> becomes consistent with <2-1>+<2-2>+<2-3> . . . +<2-n>. Here, Formula <2-n>: equal to a temperature of the object at a time nt when heating is performed from a time 0 to t and heating is held OFF from the time t to nt.

Formula <2-3>: equal to a temperature of the object at a time nt when heating is performed from a time (n-3) to (n-2), and heating is held OFF from the time (n-2) to nt.

Formula <2-2>: equal to a temperature of the object at a time nt when heating is performed from a time (n-2) to (n-1), and heating is held OFF from the time (n-1) to nt.

Formula <2-1>: equal to a temperature of the object at a time nt when heating is performed from a time (n-1) to n.

The fact that the total of the foregoing formula is equal to the formula <1>, represents that the behavior (increasing of temperature) of the temperature of the object 1 can be arithmetically predicted by obtaining the temperature of the object 1 increased per unit time by energy applied in the unit time (corresponding to each of formulae <2-1>, <2-2>, . . . <2-n>), and obtaining ground total of the temperature increased at the current timing (corresponding to <2-1>+ <2-2>+ . . . <2-n>).

Namely, for performing arithmetic operation, it becomes necessary to set "holding period of data", in which the temperature t increased in the unit time becomes zero (t=0), and "allowable calculation interval", in which error due to prediction of sequentially rising and falling of the temperature in discrete manner is allowable.

In the shown embodiment, the "holding period of data" and "allowable calculation interval" are set as shown in a following table 1 to perform calculation of the temperature transition per time constant groups of the printing head.

TABLE 1

| Thermal Time Constant | Short Range Time Constant Group | Long Range Time Constant Group |
|---|---|---|
| Allowable Calculation Interval | 0.05 sec. | 1 sec. |
| Data Holding Period | 0.80 sec. | 512 sec. |

Detection of Temperature Transition per Time Constant Group

By performing setting of each time constant group which is the temperature calculation unit of the printing head, the calculation interval per each time constant group and the calculation period (data holding period), the temperature of the printing head can be predicted by performing calculation according to the foregoing formulae. However, in general, MPU cannot directly perform exponential calculation. Therefore, for performing the foregoing calculation, it becomes necessary to perform approximated calculation or to derive the exponential calculation value from a conversion table, which requires huge amount of process. Therefore, a system is taken to preliminarily perform calculation for all possible values for storing as table data. In practice, all applicable energy which cam be applied within the unit period (from 0% to 100%) is divided per every 2.5%, i.e. into 40 applied energy ranges. Then, any applied energy can be approximated to one of the divided 40 applied energy ranges. For instance, when the applied energy is greater than or equal to zero and less than 2.5%, the applied energy is approximated to the first divided range. Similarly, when the applied energy is greater than or equal to 2.5% and less than 5%, the applied energy is approximated to the second divided range. In this manner, all of the applied energy in the range of 0% to 100% is approximated to one of the 40 ranges. On the other hand, with respect to each of the divided applied energy ranges, a characteristics of increasing and falling of temperature is preliminarily calculated. In case of the short range time constant group, the calculation interval is 0.05 seconds and the calculation period is 0.8 seconds. Therefore, behavior of temperature variation after application of energy up to 0.8 seconds is calculated at 0.05 seconds of calculation interval to obtain 16 data (=0.8/0.05) for each of the 40 divided ranges. Therefore, 640 data (=40 divided ranges*16 data) in total are stored in the table as the temperature transition data. By this, the temperature transition in the short range time constant group can be detected by making reference to the temperature transition table. Similarly, in case of the long range time constant group, for each of the divided 40 ranges, 512 data (512/1) are preliminarily calculated. Therefore, total 20480 data (=40 divided ranges*512 data) in total are stored in the table as the temperature transition data for the long range time constant group. By this, the temperature transition of the long range time constant group can be detected by making reference to the table. It should be noted that since temperature variation of the long range time constant group is quite moderate and the temperature variation within the 1 second period becomes smaller according to elapsed time after application of the energy to be handles as error, the shown embodiment stores the temperature transition data in the table with division into 14 ranges, i.e. up to 1 second, up to 3 seconds, up to 5 seconds, up to 7 seconds, up to 9 seconds, up to 11 seconds, up to 1 seconds, up to 41 seconds, up to 61 seconds, up to 81 seconds, up to 101 seconds, up to 151 seconds, up to 301 seconds and up to 512 seconds, instead of storing the results of calculation for 512 ranges divided per 1 second. Therefore, in the shown embodiment, with respect to the long range time constant group, 560 data (=40 divided ranges×14 data) in total are stored. In this way, memory consumption for storing data can be significantly reduced.

The following tables 2 and 3 respectively show the examples of resultant tables for the short range time constant group and the long range time constant group.

TABLE 2

| | 0.0%~ | 2.5%~ | 5.0%~ | 7.5%~ | 10.0%~ | 12.5%~ | | 87.5%~ | 90.0%~ | 92.5%~ | 95.0%~ | 97.5%~ |
|---|---|---|---|---|---|---|---|---|---|---|---|---|
| 0.05 sec.~ | 0.00 | 0.89 | 1.56 | 2.22 | 2.89 | 3.66 | | 14.11 | 14.21 | 14.32 | 14.42 | 14.63 |
| 0.10 sec.~ | 0.00 | 0.43 | 0.62 | 0.41 | 1.01 | 1.24 | ~ | 4.89 | 4.93 | 4.97 | 5.00 | 5.04 |
| 0.15 sec.~ | 0.00 | 0.20 | 0.25 | 0.30 | 0.35 | 0.42 | | 1.70 | 1.71 | 1.72 | 1.74 | 1.75 |
| 0.20 sec.~ | 0.00 | 0.09 | 0.10 | 0.11 | 0.12 | 0.14 | | 0.59 | 0.59 | 0.60 | 0.60 | 0.61 |
| 0.25 sec.~ | 0.00 | 0.04 | 0.05 | 0.07 | 0.08 | 0.09 | | 0.17 | 0.17 | 0.17 | 0.17 | 0.17 |
| 0.30 sec.~ | 0.00 | 0.04 | 0.05 | 0.07 | 0.08 | 0.09 | ~ | 0.17 | 0.17 | 0.17 | 0.17 | 0.17 |
| 0.35 sec.~ | 0.00 | 0.04 | 0.05 | 0.07 | 0.08 | 0.09 | | 0.17 | 0.17 | 0.17 | 0.17 | 0.17 |
| 0.40 sec.~ | 0.00 | 0.04 | 0.05 | 0.07 | 0.08 | 0.09 | | 0.17 | 0.17 | 0.17 | 0.17 | 0.17 |
| 0.45 sec.~ | 0.00 | 0.04 | 0.05 | 0.07 | 0.08 | 0.09 | | 0.17 | 0.17 | 0.17 | 0.17 | 0.17 |
| 0.50 sec.~ | 0.00 | 0.04 | 0.05 | 0.07 | 0.08 | 0.09 | ~ | 0.17 | 0.17 | 0.17 | 0.17 | 0.17 |
| 0.55 sec.~ | 0.00 | 0.04 | 0.05 | 0.07 | 0.08 | 0.09 | | 0.17 | 0.17 | 0.17 | 0.17 | 0.17 |
| 0.60 sec.~ | 0.00 | 0.04 | 0.05 | 0.07 | 0.08 | 0.09 | | 0.17 | 0.17 | 0.17 | 0.17 | 0.17 |
| 0.65 sec.~ | 0.00 | 0.04 | 0.05 | 0.07 | 0.08 | 0.09 | | 0.17 | 0.17 | 0.17 | 0.17 | 0.17 |
| 0.70 sec.~ | 0.00 | 0.04 | 0.05 | 0.07 | 0.08 | 0.09 | ~ | 0.17 | 0.17 | 0.17 | 0.17 | 0.17 |
| 0.75 sec.~ | 0.00 | 0.04 | 0.05 | 0.07 | 0.08 | 0.09 | | 0.17 | 0.17 | 0.17 | 0.17 | 0.17 |
| 0.80 sec.~ | 0.00 | 0.04 | 0.05 | 0.07 | 0.08 | 0.09 | ~ | 0.17 | 0.17 | 0.17 | 0.17 | 0.17 |
| 0.85 sec.~ | 0.00 | 0.00 | 0.00 | 0.00 | 0.00 | 0.00 | | 0.00 | 0.00 | 0.00 | 0.00 | 0.00 |

TABLE 3

| | 0.0%~ | 2.5%~ | 5.0%~ | 7.5%~ | 10.0%~ | 12.5%~ | | 87.5%~ | 90.0%~ | 92.5%~ | 95.0%~ | 97.5%~ |
|---|---|---|---|---|---|---|---|---|---|---|---|---|
| 1 sec.~ | 0.00 | 0.15 | 0.27 | 0.39 | 0.52 | 0.62 | | 2.65 | 2.68 | 2.75 | 2.75 | 2.79 |
| 3 sec.~ | 0.00 | 0.08 | 0.16 | 0.24 | 0.32 | 0.37 | ~ | 0.79 | 0.80 | 0.81 | 0.81 | 0.82 |
| 5 sec.~ | 0.00 | 0.07 | 0.09 | 0.11 | 0.13 | 0.17 | | 0.48 | 0.49 | 0.49 | 0.50 | 0.50 |
| 7 sec.~ | 0.00 | 0.12 | 0.14 | 0.16 | 0.18 | 0.20 | | 0.70 | 0.70 | 0.71 | 0.71 | 0.72 |
| 9 sec.~ | 0.00 | 0.06 | 0.11 | 0.15 | 0.20 | 0.22 | | 0.43 | 0.43 | 0.43 | 0.44 | 0.44 |
| 11 sec.~ | 0.00 | 0.05 | 0.07 | 0.09 | 0.11 | 0.13 | | 0.38 | 0.39 | 0.39 | 0.39 | 0.40 |
| 21 sec.~ | 0.00 | 0.04 | 0.05 | 0.06 | 0.07 | 0.08 | ~ | 0.17 | 0.17 | 0.17 | 0.17 | 0.17 |
| 41 sec.~ | 0.00 | 0.03 | 0.04 | 0.05 | 0.06 | 0.06 | | 0.17 | 0.17 | 0.17 | 0.17 | 0.17 |
| 61 sec.~ | 0.00 | 0.02 | 0.03 | 0.04 | 0.05 | 0.05 | | 0.10 | 0.10 | 0.10 | 0.11 | 0.11 |
| 81 sec.~ | 0.00 | 0.01 | 0.02 | 0.03 | 0.04 | 0.04 | | 0.06 | 0.06 | 0.06 | 0.06 | 0.06 |
| 101 sec.~ | 0.00 | 0.02 | 0.02 | 0.02 | 0.03 | 0.03 | | 0.06 | 0.06 | 0.06 | 0.06 | 0.06 |
| 151 sec.~ | 0.00 | 0.01 | 0.01 | 0.01 | 0.02 | 0.02 | | 0.30 | 0.30 | 0.30 | 0.30 | 0.30 |
| 301 sec.~ | 0.00 | 0.01 | 0.01 | 0.01 | 0.01 | 0.01 | ~ | 0.02 | 0.02 | 0.02 | 0.02 | 0.02 |
| 512 sec.~ | 0.00 | 0.00 | 0.00 | 0.00 | 0.00 | 0.00 | | 0.00 | 0.00 | 0.00 | 0.00 | 0.00 |

Detection of Printing Head Temperature

As set forth above, detection of the increased temperature of the time constant group of the printing head model can be detected by detecting degree of lowering of temperature at the time of temperature prediction of the increased temperature per unit time and accumulating the detected temperature. Namely, in case of temperature increase of the short range time constant group, increase of the temperature by driving of the ejection heater can be arithmetically detected by detecting the lowered temperature of the increased temperature per each unit time with reference to the foregoing table 2 and accumulating the sum of the detected temperature per 0.05 seconds. Similarly, in case of increase of the temperature of the long range time constant group, temperature increase by driving of the ejection heater can be arithmetically detected by detecting degree of lowering of temperature of the increased temperature per unit time at the time of calculation with reference to the table 3 and accumulating the sum of the detected temperature per every 1 second.

Detection of the temperature of the printing head can be detected by detecting increased temperature per the time constant groups modeled with respect to the thermal conductivities of the printing head and deriving the sum of the detected values of the increased temperature per each time constant group. Similar invention of the temperature calculating means up to here has been proposed in Japanese Patent Application Laid-open No. 208505/1993.

Re-setting of Table Data

While temperature detection of the printing head becomes possible by the construction set forth above, when improvement in the specification of the printing head or in the characteristics of the ink as consumables is significant, it is possible to cause large error in calculation of the temperature when the content of the table to be used in arithmetic prediction of the head temperature is maintained unchanged. Therefore, the shown embodiment permits appropriate modification of the table data corresponding to improvement of the consumables by performing the control discussed hereinafter.

Figure 9:
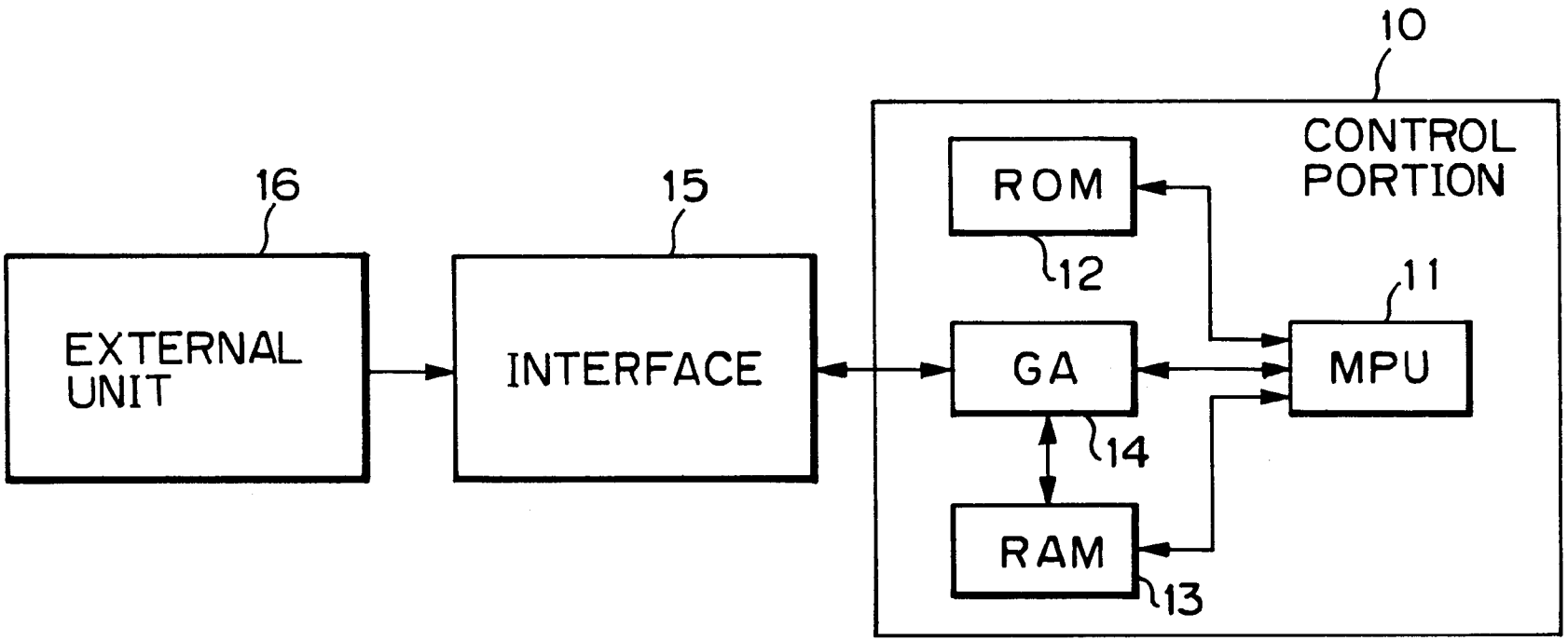
FIG. 9 is a schematic block diagram conceptually showing a construction of a control system for the first embodiment of the printing apparatus according to the invention.

FIG. 9 is a block diagram for explaining the construction of a control system of the printing apparatus according to the shown embodiment.

As shown in FIG. 9, a control portion 10 of the printing apparatus has a microprocessor unit (MPU) 11, a read-only-memory (ROM) 12 for storing control programs to be executed by the MPU 11, a dynamic type random-access memory (RAM) 13 for storing various data (printing signal, table data as printing parameter to be used for calculation of temperature, printing data to be supplied to the printing head and so forth), and a gate array (GA) 14 for performing supply control of the printing data to the printing head. In addition, the shown embodiment has an interface 15 connected to the GA 14. The interface 15 is adapted to input the printing signal or table data associated with the temperature calculation from the external unit 16. It should be noted that GA 14 performs control of data transfer between the interface 15, the MPU 11 and RAM 13. Also, as primary components of the control portion are not shown motor drivers driving carrier motor for moving the printing head and transporting motors for feeding a printing paper, or a not shown head driver for driving the printing head.

Figure 10:
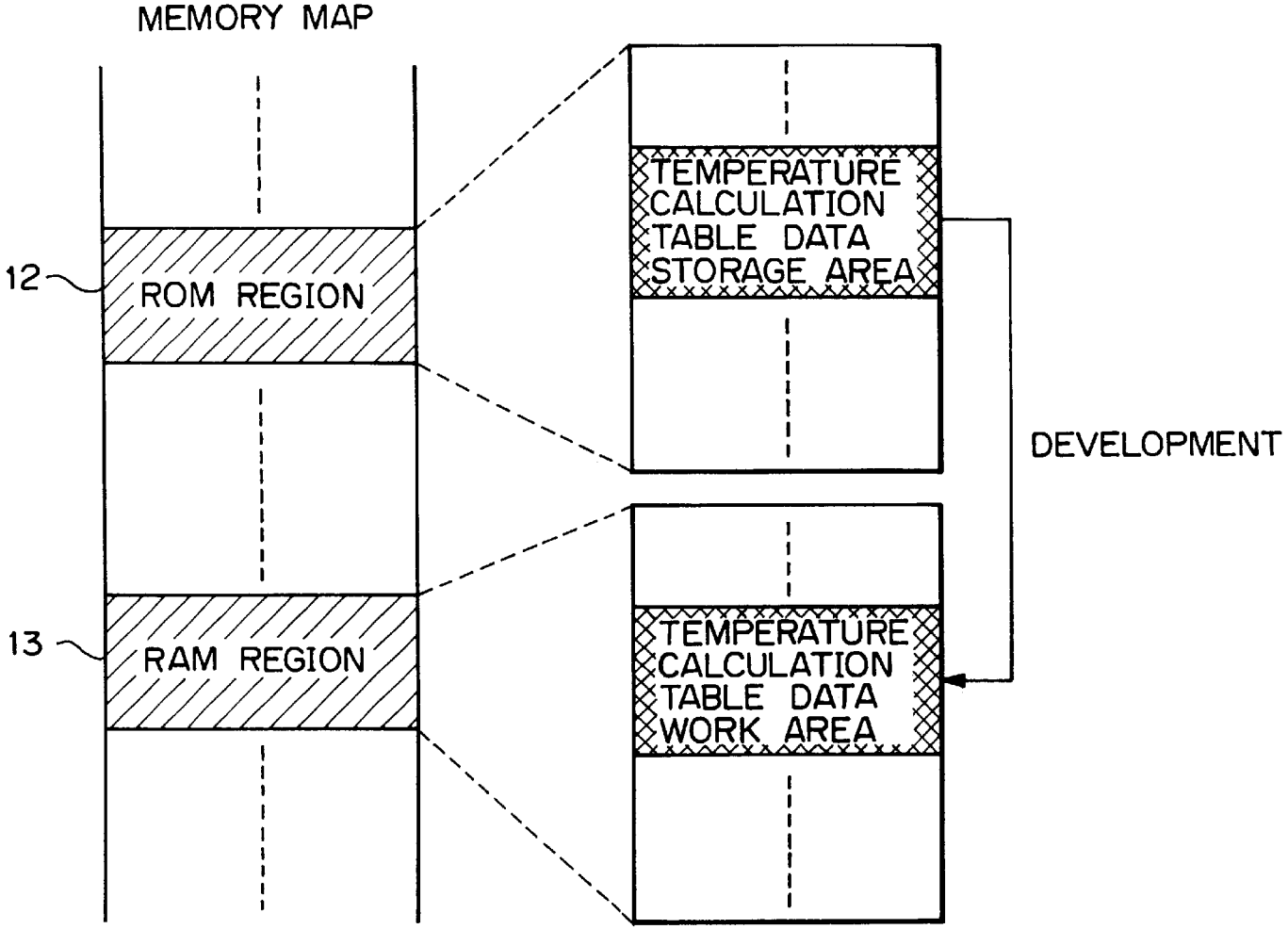
FIG. 10 is an illustration showing a construction of a memory shown in FIG. 9.

FIG. 10 is a schematic illustration of a memory map for explaining a memory construction in the shown embodiment. As can be clear from FIG. 10, in the ROM 12, table data for temperature calculation adapted to the printing head and the printing ink upon shipping of the product is stored. The control portion 10 is responsive to turning ON of power supply for the printing apparatus to copy the table data in the ROM 12 to a table data work area in the RAM 13. Subsequently, the control portion 10 makes reference to the table data stored in the table data work area to perform arithmetic prediction of the temperature of the printing head as set forth above, and to perform temperature control on the basis of the predicted temperature.

On the other hand, in the shown embodiment of the printing apparatus, a command for inputting the table data to be stored in the RAM 13 by down-loading from the external unit 16 via the interface 15.

Namely, the shown embodiment of the printing apparatus has a specification to permit freely rewriting data in the table data work area for temperature calculation in the RAM 13 by transferring the table data according to a standardized rule, by the command. By supplying a medium for updating the content of the table data work area for temperature calculation with the optimal values by the temperature calculation parameter modification command employing the specification set forth above, even in the printing apparatus employing open loop temperature calculation means, the optimal temperature prediction can be done even when the specifications of the printing head and the printing ink are varied by improvement therefor.

It should be noted that there is no special constraint for the medium as long as it has a specification which permits transfer of data to the control portion 10 of the printing apparatus via the interface. For instance, the medium may be a floppy disk corresponding to a disk drive of a personal computer as the external unit, in which the floppy disk stores the data in a form of a file. The medium may be a part of element of the printing driver.

As set forth above, according to the shown embodiment, it is possible to realize the temperature detecting system for the ink-jet printing head by permitting a strategical product development with significantly improved compatibility of the products by version-up of the consumables which is the most important feature of the ink-jet printing apparatus, with employing the open loop arithmetic process which is capable of detection of the temperature of the printing head in low cost, high accuracy and high speed without being affected by external disturbance, such as delay in response or noise which are cause in electrical detection of the temperature of the printing head employing a sensor.

(Second Embodiment)

Next, discussion will be given for another embodiment relating to setting of the printing parameter for arithmetically predicting the temperature of the printing head.

In the above-mentioned first embodiment, when improvement requiring modification of the parameter for arithmetically predicting the temperature, is provided on the printing head, the printing ink and so forth, a system is taken to transfer the arithmetic parameter via the interface. In contrast, in the shown embodiment, instead of directly transferring the parameter to the printing apparatus, the printing head temperatures over the future are arithmetically predicted by simulating the printing, previously, by the external apparatus. The resultant value of the predicting calculation is transferred to the printing apparatus via the interface. Namely, in the shown embodiment, as the printing parameter, the temperature predicted value to be the base of the head temperature control is transferred from the external unit, as the printing parameter.

In case of the system transferring the table data as in the first embodiment, increasing complexity of the system requires greater data amount to be transferred. In addition, since the same data have to be stored both in the ROM and the RAM to make memory consumption inefficient. In contrast to this, in the shown system, all of such problems can be solved by performing calculation of temperature per Me by a central processing unit (CPU) of the personal computer as the external unit.

The CPU of the personal computer is expected to be improved in the process speed in day-by-day toward the future. Therefore, it is quite effective to bear the function of high load to the CPU of the personal computer which is certainly speeded toward the future.

Upon calculation of the temperature of the printing head by open loop, the construction and operation of the components other than the control portion performing arithmetic process and the transfer data transferred from the external unit via the interface are the same or similar to the former embodiment. Therefore, detailed discussion for such common components will be neglected.

(Modified Embodiment 1)

As the modified embodiment of the foregoing embodiment, discussion will be given for a method for controlling recovery sequence for stabilizing ejection with predicting the temperature of the head from the printing duty to control suction condition depending upon the detected temperature of the head.

In the shown embodiment, similarly to the foregoing first embodiment, suction condition is varied depending upon the detected temperature of the head by detecting the current temperature of the head from the printing duty. Control of the suction condition is performed by adjusting the suction pressure (initial piston position) or suction amount (variation amount of volume or vacuum holding period).

Figure 11:
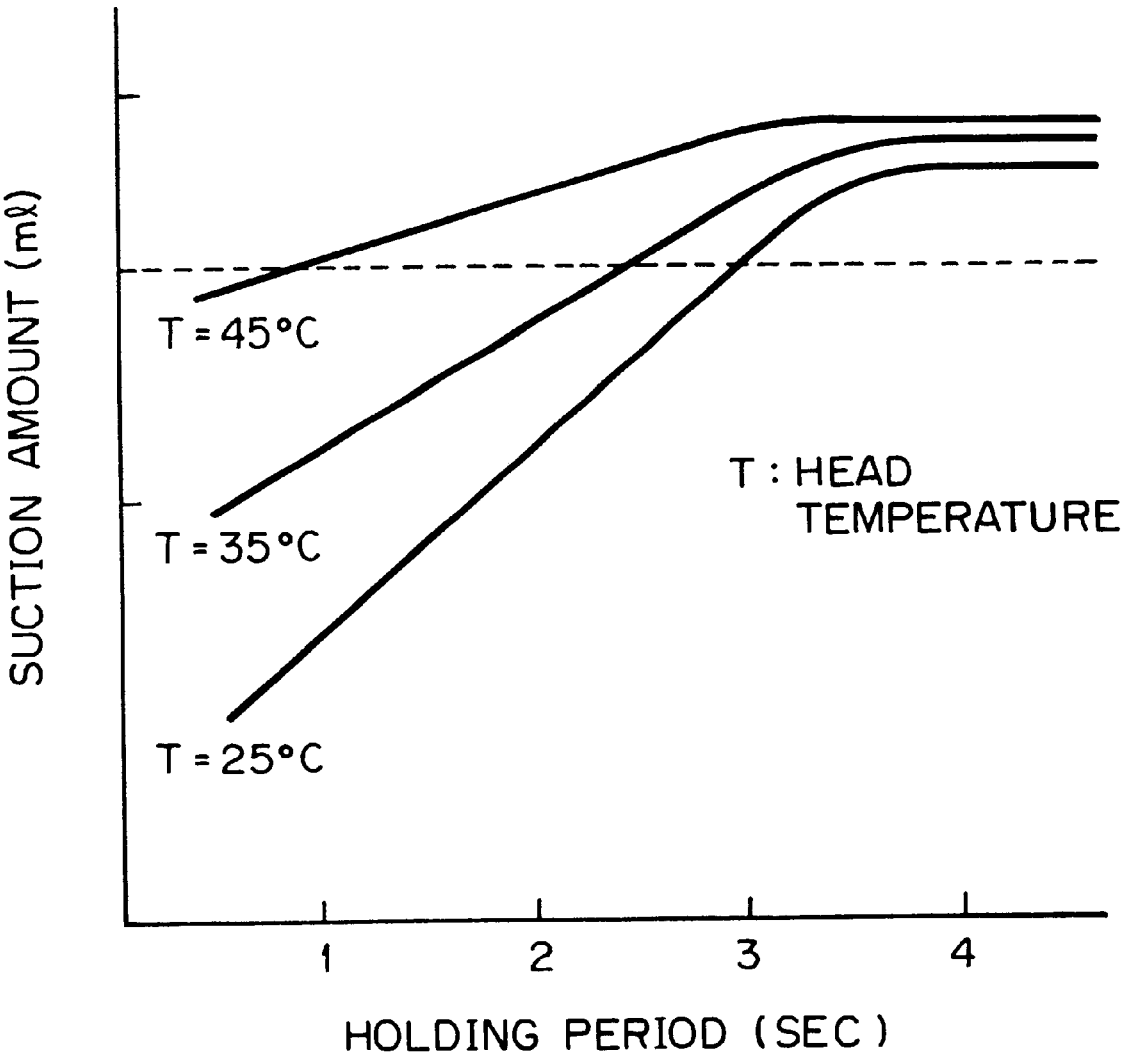
FIG. 11 PRIOR ART
FIG. 11 is an illustration showing a temperature dependency of a negative pressure holding period in a modified embodiment and an ink suction amount, in the shown embodiment.

FIG. 11 shows a head temperature dependency of the vacuum holding period and dependency to the head temperature. In certain area, the suction amount can be controlled by the vacuum holding period. However, in the area other than the foregoing area, the suction amount does not depend on the vacuum holding period. Also, the suction amount is influenced by the head temperature detected from the print duty. Therefore, the vacuum holding period is varied depending upon the detected temperature of the head. In this way, even when the head temperature is varied, ejection amount can be maintained at constant (optimal amount) to stabilize ejection.

Also, when a plurality of heads are employed, by performing radiation correction depending upon arrangement of the heads, detection of the head temperature can be done more accurately. Since the end of the carriage radiates greater heat than the center portion, fluctuation can be caused in temperature distribution. Thus, ejection which significantly influenced by the temperature, also fluctuates. Therefore, in the shown embodiment, correction is made with taking the radiation at the end portion 100% and at the center portion 95%. By this correction, thermal fluctuation can be eliminated to permit stable ejection. It is further possible to vary the suction condition depending upon the characteristics and condition of each of the individual heads.

Furthermore, in the shown embodiment, detection of temperature drop at the head is performed during suction. In the case where environmental temperature and the head temperature are different, high temperature ink is discharged by suction and low temperature ink is supplied from the ink tank. By the supplied low temperature ink, the head in the high temperature condition is cooled. In the following table 4, a difference between the environmental temperature and the detected temperature of the head and a temperature drop correction in suction. In the case where the head temperature is detected from the printing duty, temperature drop during suction can be compensated on the basis of the difference to the environmental temperature, and, in conjunction therewith, the head temperature after suction can be predicted.

TABLE 4

| Difference between Environmental Temperature and Head Predicted Temperature (° C.) | ΔT Upon Suction (° C.) |
|---|---|
| 0~10 | −1.2 |
| 10~20 | −3.6 |
| 20~30 | −6.0 |

In case of replaceable head, it becomes necessary to detect temperature of the ink tank. Since the ink tank is tightly fitted to the head, increase of the temperature by ejection inherently influences for the ink tank. Therefore, the ink tank temperature is detected from an average temperature in the last ten minutes. By this, the ink tank temperature may be fed back in temperature drop of the head during suction.

In case of the permanent head, since the head and the ink tank are spaced away from each other. Therefore, the temperature of the ink to be supplied is substantially equal to the environmental temperature, and thus is not required to perform temperature prediction for the ink tank.

Figure 12:
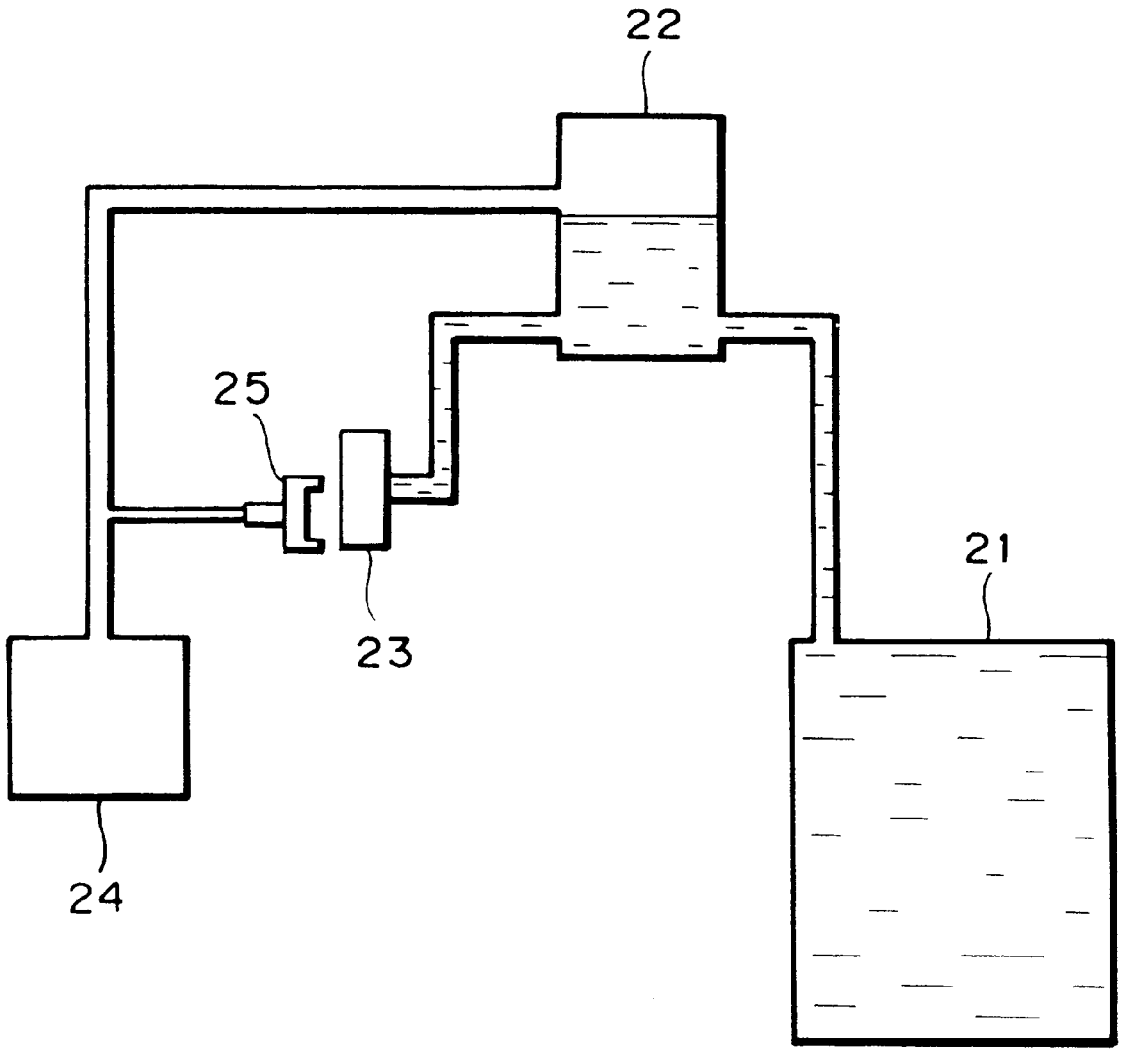
FIG. 12 PRIOR ART
FIG. 12 is a schematic illustration showing a model of a sub-tank system in the foregoing embodiment.

Furthermore, discussion will be given in the case of a sub-tank system as illustrated in FIG. 12, where a sub-tank 22 communicated with a main tank 21 is provided, the ink is supplied to the printing head 23 from the sub-tank 22, a pump 24 is connected to the cap 25 and the sub-tank 22. In such sub-tank system, if suction is performed in the condition where the ink temperature is high, suction amount becomes large to make it impossible to expect pulling-up effect of meniscus and thus can be a cause of failure of ink supply. Therefore, when the head temperature predicted from the printing duty is high temperature, number of times to perform suction is increased to attain the meniscus pulling-up effect.

In the following table 5, a relationship between the difference between the environmental temperature and the detected temperature of the head and the number of times to effect suction, is shown. Namely, greater number of times to effect suction is set at greater difference between the detected head temperature and the environmental temperature. By this, failure of the meniscus pulling-up effect is avoided.

TABLE 5

| Difference between Environmental Temperature and Head Predicted Temperature (° C.) | Number of Times to Effect Suction |
|---|---|
| 0~10 | 8 |
| 10~20 | 10 |
| 20~30 | 12 |

(Modified Embodiment 2)

While the shown embodiment detects the current temperature of the printing head from the printing duty similarly to the foregoing modified embodiment 1, the shown embodiment adjusts a condition for preliminary-ejection depending upon the predicted temperature of the head.

When the head temperature is high, ejection amount is increases as set forth above. Therefore, in such case, it is possible to perform wasteful ejection. Therefore, in this case, control may be performed to narrow the pulse width for the preliminary-ejection.

The following table 6 shows a relationship between the detected temperature of the printing head and the pulse width. As can be seen, since the greater amount can be ejected at higher temperature, the ejection amount is restricted by reducing the pulse width correspondingly.

TABLE 6

| Predicted Head Temperature (° C.) | Pulse Width (μsec) |
|---|---|
| 20~30 | 7.0 |
| 30~40 | 6.5 |
| 40~50 | 6.0 |
| 50~ | 5.5 |

On the other hand, since higher temperature should cause greater fluctuation of temperature between the ejection orifices, it becomes necessary to optimize distribution of number of pulses for preliminary-ejection.

The following table 7 shows a relationship between the predicted temperature of the printing head and the number of pulses for preliminary-ejection. Even under normal temperature, a difference of number of times of preliminary-ejection is provided between the end portion and the center portion of the ejection array to restrict influence of fluctuation of the temperature. Since higher temperature of the head inherently increase the difference of temperature between the end portion and the center portion, greater difference in the number of times of preliminary-ejection is provided. By this, fluctuation of temperature distribution between the orifices can be suppressed to permit effective (required minimum times of) preliminary-ejection with satisfactory stability of ejection.

TABLE 7

| Predicted Head Temperature (° C.) | 1~16 orifices | 17~48 orifices | 49~64 orifices |
|---|---|---|---|
| 20~30 | 10 | 8 | 10 |
| 30~40 | 10 | 7 | 10 |
| 40~50 | 10 | 6 | 10 |
| 50~ | 10 | 5 | 10 |

Also, in case of using a plurality of heads, the temperature table for preliminary-ejection may be varied for respective colors.

The following table 8 shows one example of the temperature table. When the temperature of the printing head is high, in comparison with Y (yellow), M(magenta) and C(cyan), Bk (black) containing greater amount of dye has greater tendency to increase viscosity. Therefore, it becomes necessary to make number of times of preliminary-ejection greater than that for other colors. Also, since higher temperature causes greater ejection amount as set forth above, the number of times of preliminary-ejection is set at smaller value at higher temperature.

TABLE 8

| Predicted Head Temperature (° C.) | Y, M, C | Bk |
|---|---|---|
| 20~30 | 16 | 24 |
| 30~40 | 14 | 21 |
| 40~50 | 12 | 18 |
| 50~ | 10 | 15 |

Figure 13B:
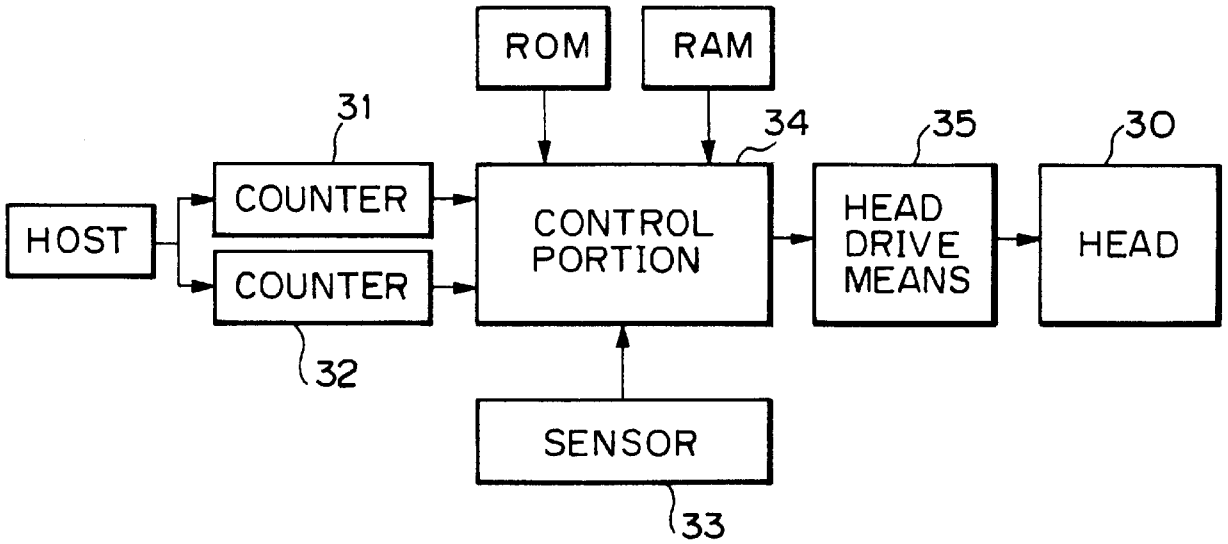
FIG. 13B PRIOR ART
FIGS. 13A and 13B are illustrations showing a modified embodiment of the first embodiment for the case where a multi ejection orifices are provided.
Figure 13A:
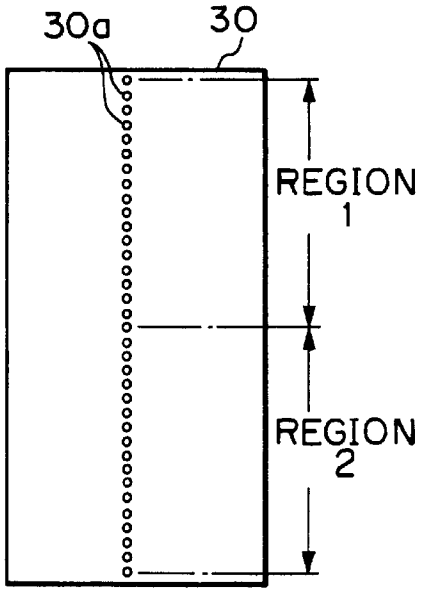
FIG. 13A PRIOR ART

Also, in case that number of the ejection orifices is large, it is possible to take a method to predict the temperature of the printing head with dividing a plurality of ejection orifices into a plurality of groups, as illustrated in FIGS. 13A and 13B. Namely, the ejection orifices 30*a* of the head 30 are divided into one group placed in a region 1 and another group placed in a region 2. For respective regions 1 and 2, counters 31 and 32 for deriving printing duties independently of each other are provided. With respect to each of the regions 1 and 2, the head temperature is predicted on the basis of independently derived printing duty. On the basis of these detected values and a detected data from a sensor 33, the condition for the preliminary-ejection can be set independently for each of the regions 1 and 2 of the printing head 30 through a control portion 34 and a head driving means 35. In this way, an error in prediction of the head temperature based on the printing duty can be reduced.

(Modified Embodiment 3)

In the shown embodiment, there is illustrated an example for operating a predetermined recovery means at an optically set intervals depending upon an average head temperature, by predicting the temperature of the printing head on the basis of the printing duty. The recovery means controlled depending upon the average head temperature in the shown embodiment, is the preliminary-ejection and wiping to be performed at a predetermined interval during printing (namely, while the cap is held open). The preliminary-ejection is, as well known in the ink-jet technology, performed for the purpose of prevention of failure of ejection or variation of the printing density which are caused by evaporation of the ink from the ejection orifice. In consideration of the fact that the evaporation amount of the ink is variable depending upon the temperature at the printing head, the shown embodiment sets the interval of the pre-ejection and number of times of the preliminary-ejection depending upon the average head temperature so as to efficiently perform preliminary-ejection in view point of time or consumption of the ink.

In the open loop temperature control as major element of the shown embodiment, namely in the system for arithmetically predicting the current temperature of the printing head on the basis of a detected temperature of a reference temperature sensor provided on the main body and a past printing duty, the average temperature of the printing head within a past predetermined period, which becomes necessary in implementation of the shown embodiment, can be easily obtained. Evaporation of the ink is related to the head temperature at respective timing. The shown embodiment is worked out with paying attention for the fact that the total amount of evaporation of the ink within the predetermined period has strong relationship with average head temperature in the corresponding period. On the other hand, in the system for directly detecting the head temperature, it is relatively easy to control the pre-ejection depending on the head temperature at respective instantaneous timing, in real time. However, in order to obtain the past average head temperature which is required in the control according to the shown embodiment, it becomes necessary to provide special storage and arithmetic circuit.

The wiping means as another ejection stabilizing means controlled in the shown embodiment is performed for the purpose of removal of unnecessary liquid, such as water vapor and solid-state foreign matters, such as paper dust, dirt, adhering on the surface where the ejection orifices are formed (hereinafter referred to as orifice forming surface). In the shown embodiment, with paying attention for the fact that the wetting amount by the ink and so forth is different depending upon the temperature of the head and evaporation of wetting which makes removal of the ink and foreign matter difficult, is related to the temperature of the orifice forming surface, wiping is made efficient by setting the optimal wiping interval depending upon the past average temperature of the printing head. The wetting amount and evaporation of wetting associated with wiping has stronger correlation to the past average temperature of the head rather than the instantaneous head temperature at the timing of performing wiping. Therefore, the predicting means of the head temperature in the shown embodiment is preferred.

Figure 14A:
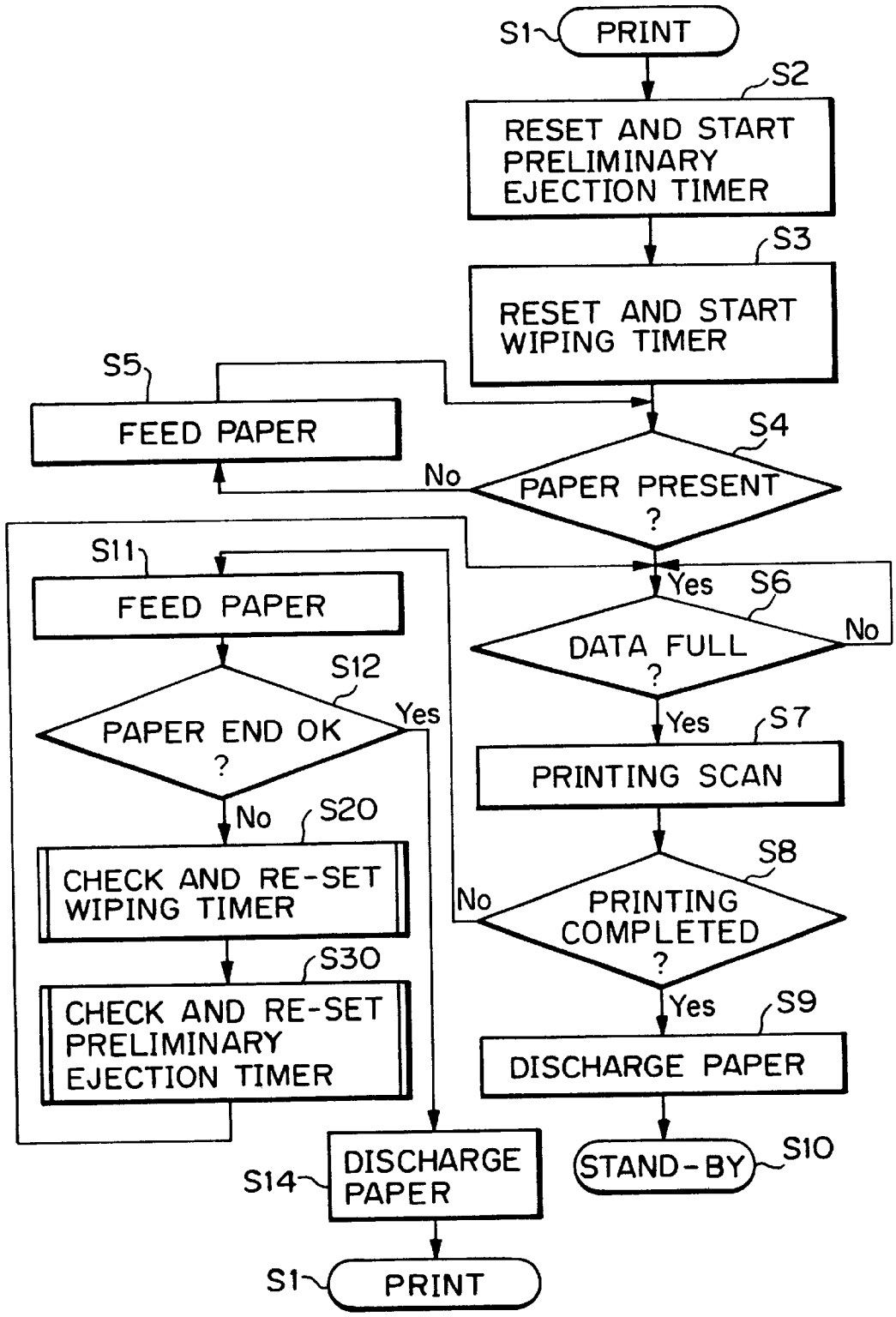
FIG. 14A PRIOR ART
FIGS. 14A, 14B and 14C are flowcharts showing a printing sequence in the modified embodiment of the first embodiment of the present invention.
Figure 14B:
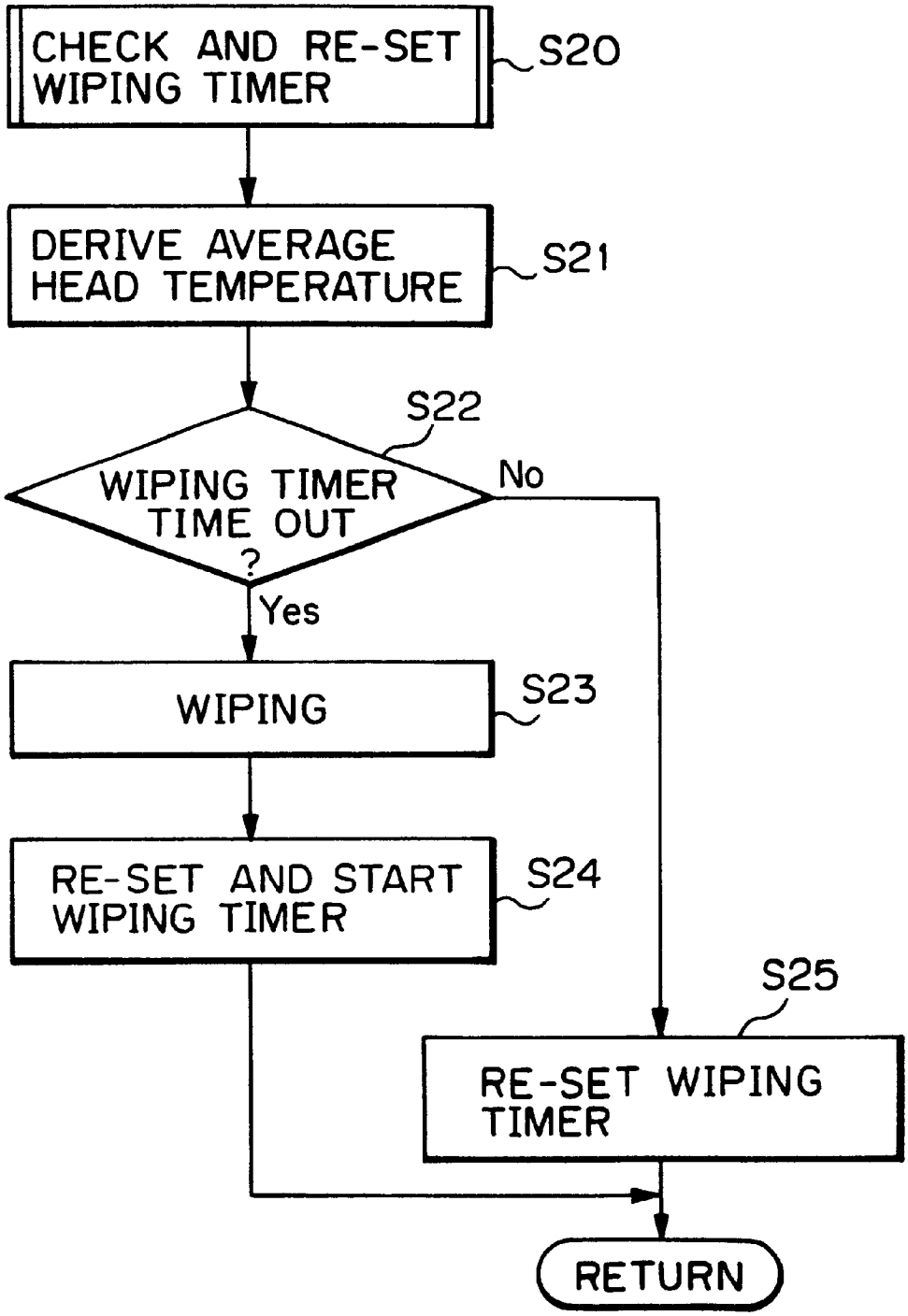
FIG. 14B PRIOR ART
Figure 14C:
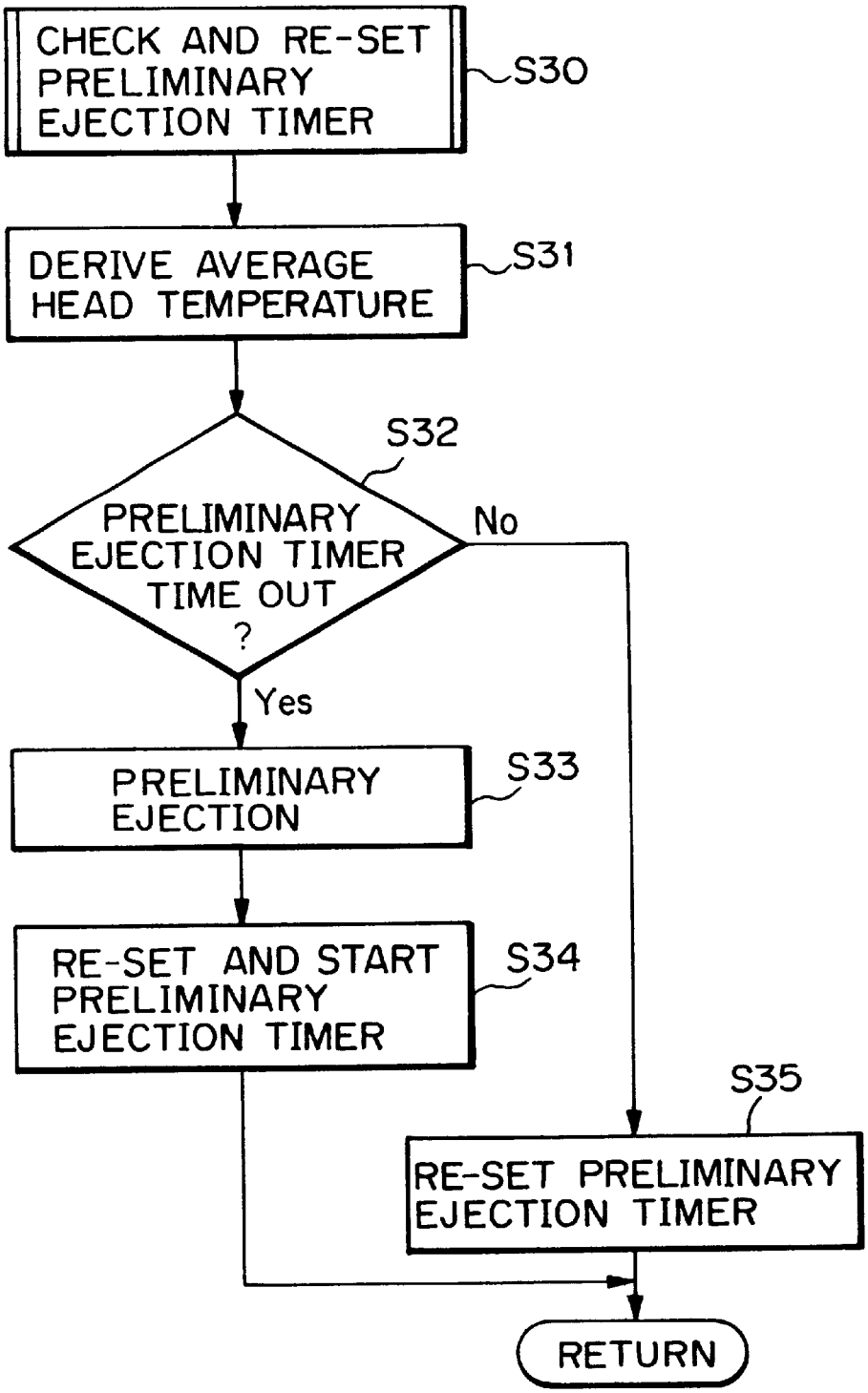
FIG. 14C PRIOR ART

FIG. 14 is a flowchart showing a general sequence of printing of the shown embodiment of the ink-jet printing apparatus. When a signal commanding printing is input (step S1), a print sequence is executed. At first, a preliminary-ejection timer is set depending upon an average head temperature at that timing, and then measurement of the elapsed time is initiated (step S2). Also, a wiping timer is set depending upon the average head temperature at that timing and, then started (step S3). Next, judgement is made whether a paper as a printing medium is present or not (step S4). If the paper is not present, the paper is supplied (step S5). Thereafter, judgement is made whether the data input is completed or not (step S6). As soon as completion of the input of the data, scanning of the carriage (printing scan) is performed for printing for one line (step S7).

Then, judgement is made whether printing is completed or not (step S8). If printing is completed, the paper is discharged (step S9). Thereafter, the apparatus is returned to a stand-by state (step S10). When printing is to be continued, the paper is fed for a predetermined amount (step S11). Thereafter, check of the rear end of the paper is performed (step S12). When the rear end of the paper is detected, the paper is discharged (step S14). Then, the process is returned to initiation of printing (step 1). If not the rear end of the paper, the wiping timer and the preliminary-ejection timer which are set depending upon the average temperature of the printing head, are checked and re-set (steps S20 and S30). In checking and re-setting of the wiping timer or the preliminary-ejection timer (steps S20 and S30), irrespective of implementation of the operation, the average heat temperature is derived (steps S21 and S31). Then, check is performed whether the wiping timer or the preliminary-ejection timer becomes time out (steps S22 and S32). When one or both of the wiping timer and the preliminary-ejection timer become time out, wiping is performed (step S23) or the preliminary-ejection is performed (step S33). Thereafter, the wiping timer and the preliminary-ejection timer are re-set depending upon the derived temperature and started (steps S24 and S34). If the wiping timer and the preliminary-ejection timer do not become time out, re-setting of the wiping timer and the preliminary-ejection timer are performed depending upon the derived temperature without performing wiping and preliminary-ejection (steps S25 and S35).

Namely, in the shown embodiment, the timing of the wiping and the preliminary-ejection are precisely re-set depending upon variation of the average head temperature per printing line. Thus, optimal wiping and preliminary-ejection can be performed depending upon the condition of the evaporation and wetting of the ink. After predetermined recovery operation, waiting completion of data input, the foregoing steps are repeated to perform printing scan, again.

The following table 9 is a correspondence table of the interval of the preliminary-ejection and number of times of preliminary-ejection depending upon the average head temperature within a past 12 seconds. The table 9 is also a correspondence table of the interval of the preliminary-ejection and number of times of preliminary-ejection depending upon the average head temperature within a past 48 seconds. In the shown embodiment, according to increasing of the average head temperature, the interval is shortened and number of times of preliminary-ejection is reduced. Conversely, according to lowering of the average head temperature, the interval is set longer than number of times of preliminary-ejection is increased. These setting may be appropriately done with taking ejection characteristics depending upon evaporation characteristics and viscous increasing characteristics of the ink, into account. In case of the ink which contains large proportion of non-volatile solvent which is considered to lower viscosity by increasing of temperature rather than increasing of the viscosity due to evaporation, the interval of the preliminary-ejection may be set longer at high temperature.

Concerning wiping, in case of the normal liquid ink, wetting amount and difficulty of removal tends to be increased according to increasing of the temperature. Therefore, at high temperature, wiping is performed frequently. While the shown embodiment has been discussed for the case where the printing head is only one, in case of the apparatus realizing color printing or high speed printing employing a plurality of printing heads, it is possible to control the recovery condition depending upon the average head temperature per the printing head. On the other hand, it is possible to simultaneously operate together with the printing head having the shortest interval.

TABLE 9

| Predicted | Prediction of Past 12 seconds Pre-Ejection | | Prediction of Past 48 seconds | Prediction of Past 12 hours |
|---|---|---|---|---|
| Head Temperature (° C.) | Interval (sec) | Number of Pulses | Wiping Interval (sec) | Suction Interval (Hour) |
| 20~30 | 12 | 16 | 48 | 72 |
| 30~40 | 9 | 12 | 36 | 60 |
| 40~50 | 6 | 8 | 24 | 48 |
| 50~ | 3 | 4 | 12 | 3 |

It should be noted that, as discussed with respect to the first embodiment, not only the current head temperature but also the future head temperature can be easily predicted. Therefore, it is further possible to set the optimal preliminary-ejection interval and number of times of preliminary-ejection with taking the future ejecting condition into account.

(Modified Embodiment 4)

In the shown embodiment, similarly to the foregoing third modified embodiment, as an example of recovery control on the basis of prediction of the average head temperature, an example of the suction recovery depending upon the derived value of the past average head temperature over a relatively long period, is shown. The printing head of the ink-jet printing apparatus can be constructed to have negative water head at the ejection orifices for the purpose of stabilization of meniscus configuration at the ejection orifices of the printing head. Unexpected bubble in the ink passage can be a cause of various problems in the ink-jet printing apparatus. In the system, in which the negative water head is to be maintained, formation of bubble in the ink passage particularly causes problems.

Namely, even when printing operation is not performed, problem is arisen by growth of the bubble in the liquid passage or ink passage which can be a border of normal ejection, due to dissociation of molten gas in the ink or gas exchange via the fluid passage forming member by simply leaving in non-use. The suction recovery means is provided for the purpose of removal of bubble in the fluid passage and/or ink of increased viscosity due to evaporation at the tip end of the ejection orifices. While the evaporation of the ink is varied depending upon the temperature of the printing head as set forth above, possibility of growth of the bubble in the fluid passage is increased at higher temperature for greater influence of the head temperature. In the shown embodiment, as shown in the foregoing table 9, the interval of the suction recovery is set depending on the average head temperature over past 12 hours to more frequently perform suction recovery at higher average head temperature. Re-setting of the average temperature may be performed per every one page of printing.

It should be noted as set out with respect to the first embodiment, not only the predicted temperature at the current timing but also the future head temperature may easily be predicted. Therefore, with taking the future ejecting condition into account, optimal suction recovery control may be set.

For instance, even when the ejection failure is feared upon high duty printing at the predicted head temperature at the current timing for high duty printing, and if it is appreciated that the high duty printing is not performed in the future, suction operation may be postponed to perform suction upon feeding and discharging of the printing medium. This may permit shortening of the total printing period.

(Modified Embodiment 5)

The shown embodiment shows an example for performing control of a recovery system depending upon hysteresis of temperature predicted from the printing duty.

The foreign matter, such as ink and so forth is deposited on the orifice forming surface to deflect the ejecting direction, or to cause failure of ejection occasionally. As a recovering means for degradation of the ejection characteristics, the wiping means is provided. However, when a wiping member having further greater wiping force is provided, it may be possible to increase wiping ability by temporarily modifying the wiping condition. In the shown embodiment, by temporarily increasing penetration magnitude (intrusion magnitude) of a wiping member formed with a rubber blade into the orifice forming surface to temporarily increase wiping ability (scraping mode).

Deposition of the foreign matter which requires wiping is associated with the wetting ink amount, residual amount in wiping and evaporation thereof, and has confirmed that has strong correlation with the number of times of ejection and the temperature upon ejection through experiments. Therefore, in the shown embodiment, the scraping mode is controlled depending upon the number of times of ejections which is weighted by the temperature of the head. The following table 10 shows a weighting coefficient to be multiplied with the number of times of ejection as the basic data of the printing duty depending upon the temperature of the head detected from the printing duty. Namely, at high temperature, at which possibility of causing wetting or residual in wiping is high, the number of times of ejection as indicia of deposition nominally becomes large in control.

TABLE 10

| Predicted Head Temperature (° C.) | Weighting for Number of Pulses |
|---|---|
| 20~30 | 1.0 |
| 30~40 | 1.2 |
| 40~50 | 1.4 |
| 50~ | 1.6 |

In the shown embodiment, when the weighted number of times of ejection reaches 5 million times, scraping mode becomes active. While the scraping mode is effective in removal of the deposited substance, it is possible to cause mechanical damage to the orifice forming surface for strong scraping or wiping force. Therefore, it is desirable to perform possible least times. To perform control on the basis of the data directly correlated to deposition of the foreign matter can be simple in construction and can have high certainty. In case of the system having a plurality of heads, the printing duty may be managed per color to control the scraping mode per ink colors which have mutually different deposition characteristics.

It should be noted that, as discussed with respect to the first embodiment, the head temperature can be easily predicted not only for the temperature at the current timing but also for the temperature in the future. Therefore, in calculation of the "weighted number of times of ejection", the "weighted number of times of ejection" with taking the future ejecting condition into account may be used for setting optimal control.

(Modified Embodiment 6)

The shown embodiment is directed to an example of suction recovery similar to the foregoing fourth modified embodiment. However, in the shown embodiment, further precise detection of the bubble in the fluid passage can be achieved by detecting the bubble generated during printing (printing bubble) in addition to detection of increasing of bubble in leaving in non-use state (non-use bubble). As set forth above, evaporation of the ink is varied depending upon the temperature of the printing head. Growth of bubble in the fluid passage is further strongly influenced by the temperature of the head to have higher possibility at higher temperature. From this fact, it should be appreciated that detection of the non-use bubble can be done by measuring the non-use period weighted by the head temperature.

The possibility of generation of the printing bubble is higher at higher head temperature. Also, number of times of ejection naturally has positive correlation to possibility of generation of the printing bubble. Therefore, it should be appreciated that the printing bubble may be detected by measuring the number of times of ejection weighted by the head temperature. In the shown embodiment, as shown in the following table 11, the bubble may be removed by setting a point number (non-use bubble) depending upon the non-use period and a point number (printing bubble) depending upon number of times of ejection and performing suction recovery under judgement that the bubble in the fluid passage may influence to ejection when the total of the point number reaches hundred million points.

TABLE 11

| Predicted Head Temperature (° C.) | Point Number Depending Upon Non-Use period (points/sec) | Point Number Depending Upon Number of Dots (points/sec) |
|---|---|---|
| 20~30 | 385 | 46 |
| 30~40 | 455 | 56 |
| 40~50 | 588 | 65 |
| 50~ | 769 | 74 |

Matching of the printing bubble and the non-use bubble is experimentarily derived so that the point numbers to cause failure of ejection in sole factor under the constant temperature condition become equal to each other. In addition, the weighting value depending on the temperature can also be experimentally obtained. As a means for removing the bubble from the head, the suction means or the pressurizing means shown in the embodiments may be employed. Furthermore, a suction means which operates in a condition that ink in the fluid passage is not present may be employed.

It should be noted that, as described in the first embodiment, not only temperature of the printing head at current timing but also that of future timing can be easily predicted. Therefore, it is possible to set the optimal control by detecting "evaporation characteristics of the ink" or "growth of bubble in the fluid passage" and utilizing "evaporation characteristics of the ink" or "growth of bubble in the fluid passage" with taking the predicted future condition of ejection into account.

It should be noted that while the shown embodiment employs the power supply period as indicator of applied energy for the head, the item to be taken as the indicator of applied energy for the head is not specified to the power supply period. For example, when PWM control is not performed or when high precision temperature prediction is not required, it is possible to simple use the printing dot number. Also, when no significant variation is caused in the printing duty, it is possible to use the printing period and non-printing period.

(Third Embodiment)

The shown embodiment is directed to the construction for setting the drive pulse for driving the printing head as printing parameter by an external unit.

In advance of discussion for setting of the drive pulse in the shown embodiment, a method for driving the printing head will be discussed briefly.

Method for Driving-Printing Read

Figure 15:
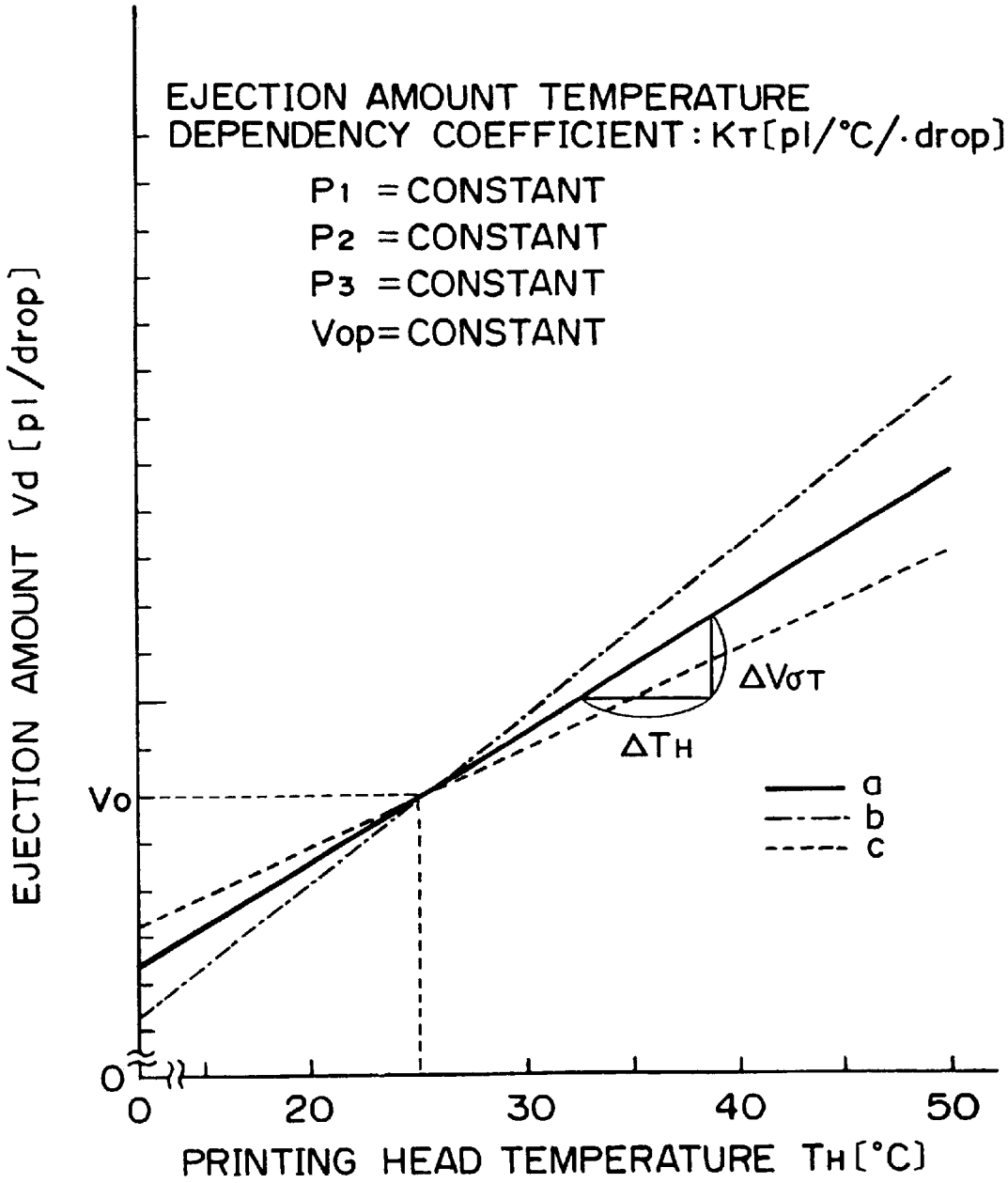
FIG. 15 PRIOR ART
FIG. 15 is an illustration showing a temperature dependency of the ejection amount in the third embodiment of the present invention.

One factor for determining the ejection amount of the ink-jet printing head is an ink temperature at the ejecting portion (in some case, it can be replaced with the temperature of the printing head). FIG. 15 is a chart showing a temperature dependency of the ejection amount in the case where the drive pulse condition is held fixed. As shown by a curve a in FIG. 15, in relation to increasing of the printing head temperature $T_H$ (since the shown case is a static temperature characteristics, it is equal to the ink temperature), the ejection amount Vd is increased linearly. Defining the gradient of the straight line as a temperature dependency coefficient, the temperature dependency coefficient $K_T$ can be expressed by the following equation:

$$K_T = \Delta V_{d/} \Delta T_H (p1/° \text{ C.} \cdot \text{drop})$$

The coefficient $K_T$ is determined by physical property of the ink in the head instead of the drive condition. In FIG. 15, curves b and c show the cases of other printing heads.

Figure 16:
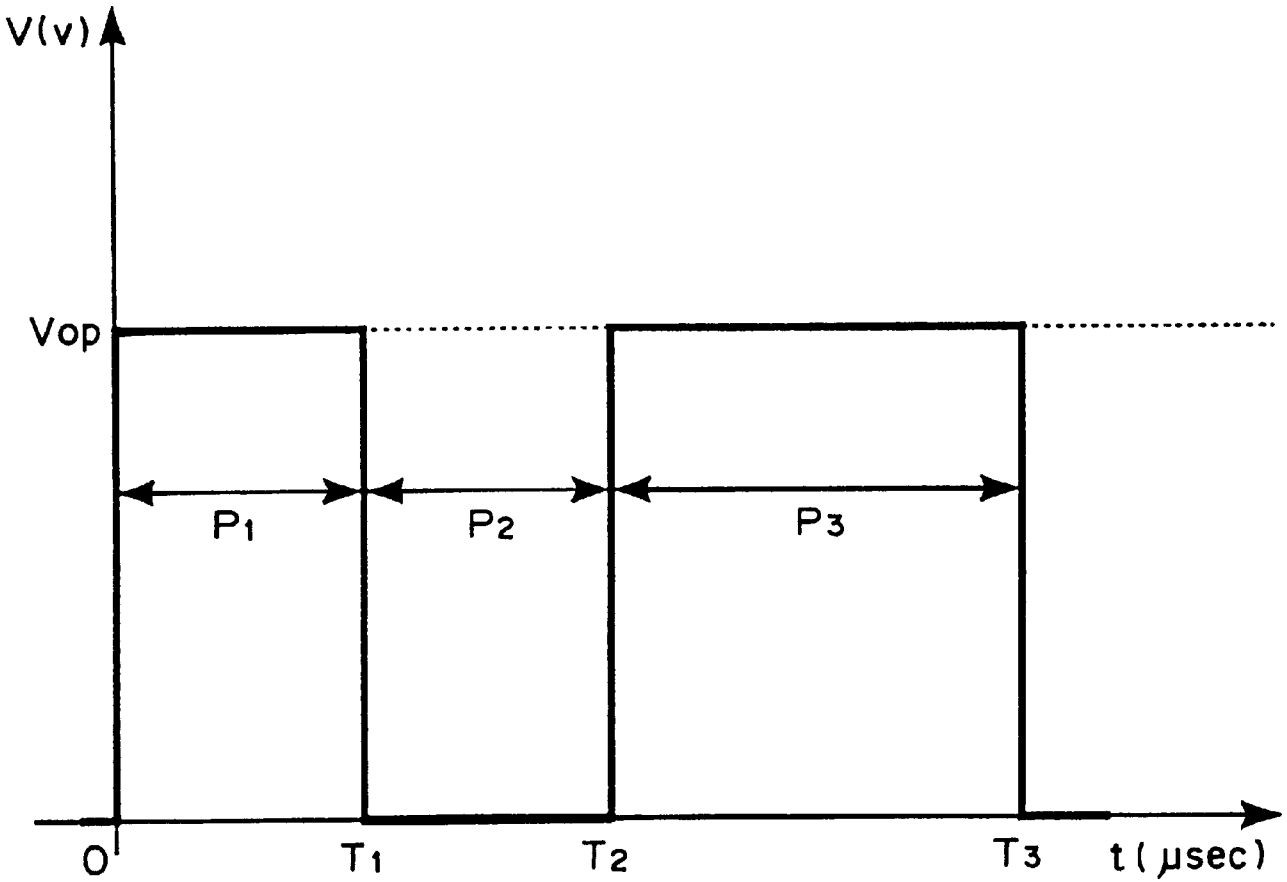
FIG. 16 PRIOR ART
FIG. 16 is an explanatory illustration showing a PWM control in the third embodiment of the invention.

The shown embodiment is directed to control the fluctuation of ejection amount due to variation of the ink temperature to maintain the ejection amount constant by PWM (pulse width modulated) drive of the ejection heater. FIG. 16 is an illustration for explaining a divided pulse in the shown embodiment. In FIG. 16, $V_{op}$ denotes a drive voltage to be applied to the ejection heater, $P_1$ denotes the pulse width of the first pulse (hereinafter referred to as "pre-pulse") of the heating pulse which is divided into a plurality of pulses, $P_2$ denotes an interval time, $P_3$ denotes the pulse width of the second pulse (hereinafter referred to as "main pulse"). $T_1$, $T_2$ and $T_3$ denote periods for determining $P_1$, $P_2$ and $P_3$.

Figure 17:
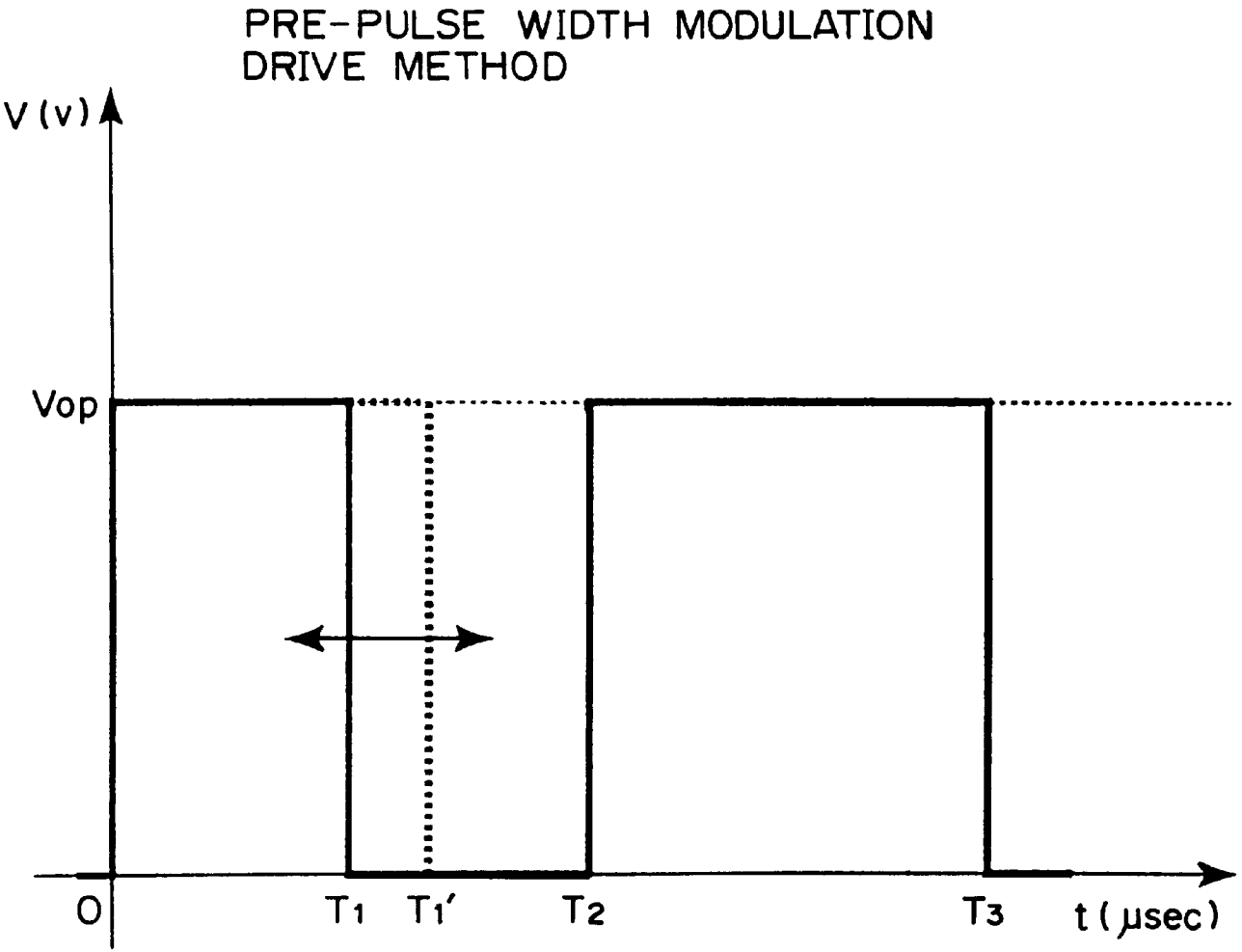
FIG. 17 is an explanatory illustration showing a pre-pulse control in the third embodiment of the invention.
Figure 18:
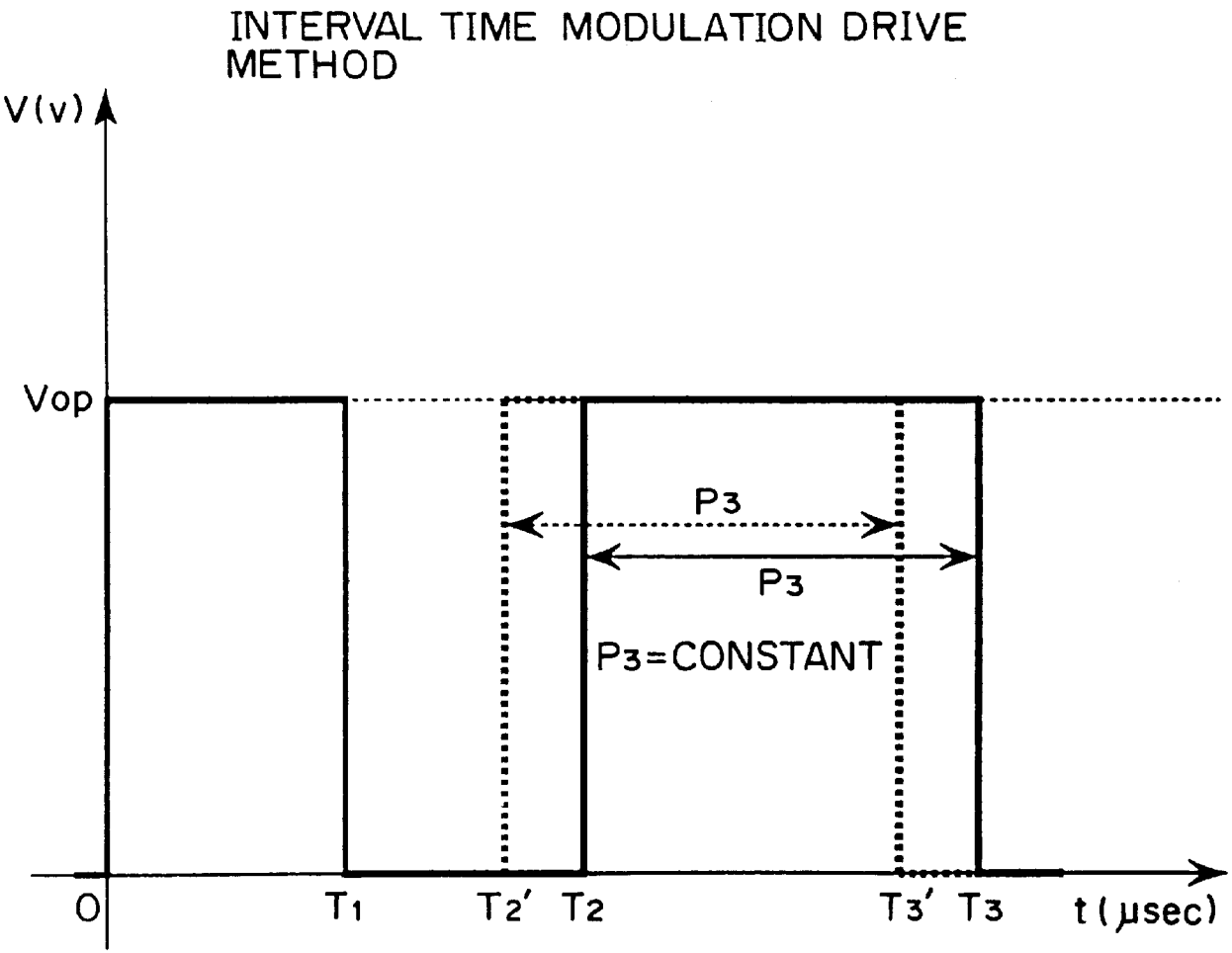
FIG. 18 is an explanatory illustration showing an interval time control in the third embodiment of the invention.

There are generally two method in a PWM ejection amount control. One method is the driving method illustrated in FIG. 17, which is referred to as a pre-pulse width modulation driving method to modulate $T_1$ with maintaining $T_2$ and $T_3$ constant. Another method is the driving method illustrated in FIG. 18, which is referred to as an interval width modulation method, in which $(T_2-T_1)$ is modulated with maintaining $T_1$ and $(T_3-T_2)$ constant.

Figure 19:
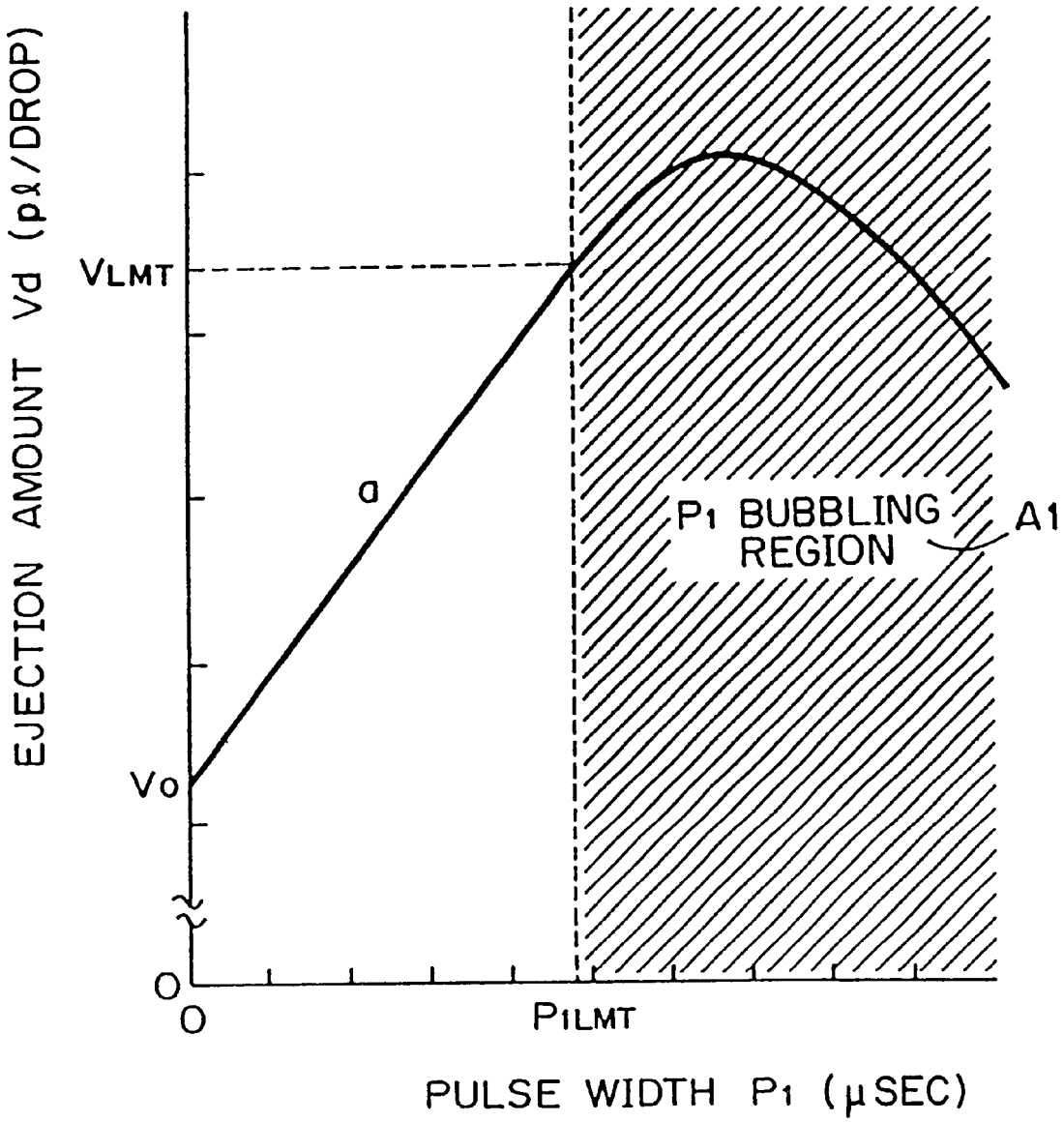
FIG. 19 is a chart showing a pre-pulse dependency of the ejection amount in the third embodiment of the invention.

Variation of the ejection amount in a former control is illustrated in FIG. 19. According to increasing of $T_1$, the ejection amount is increased and then decreased across one peak and then enters in a region A1, in which bubble is generated by the pulse of $P_1$. In case of this driving method, lineality of ejection amount relative to modulation of $T_1$ can be provided by optimizing the setting region of $T_1$. Therefore, control can be facilitated.

Figure 20:
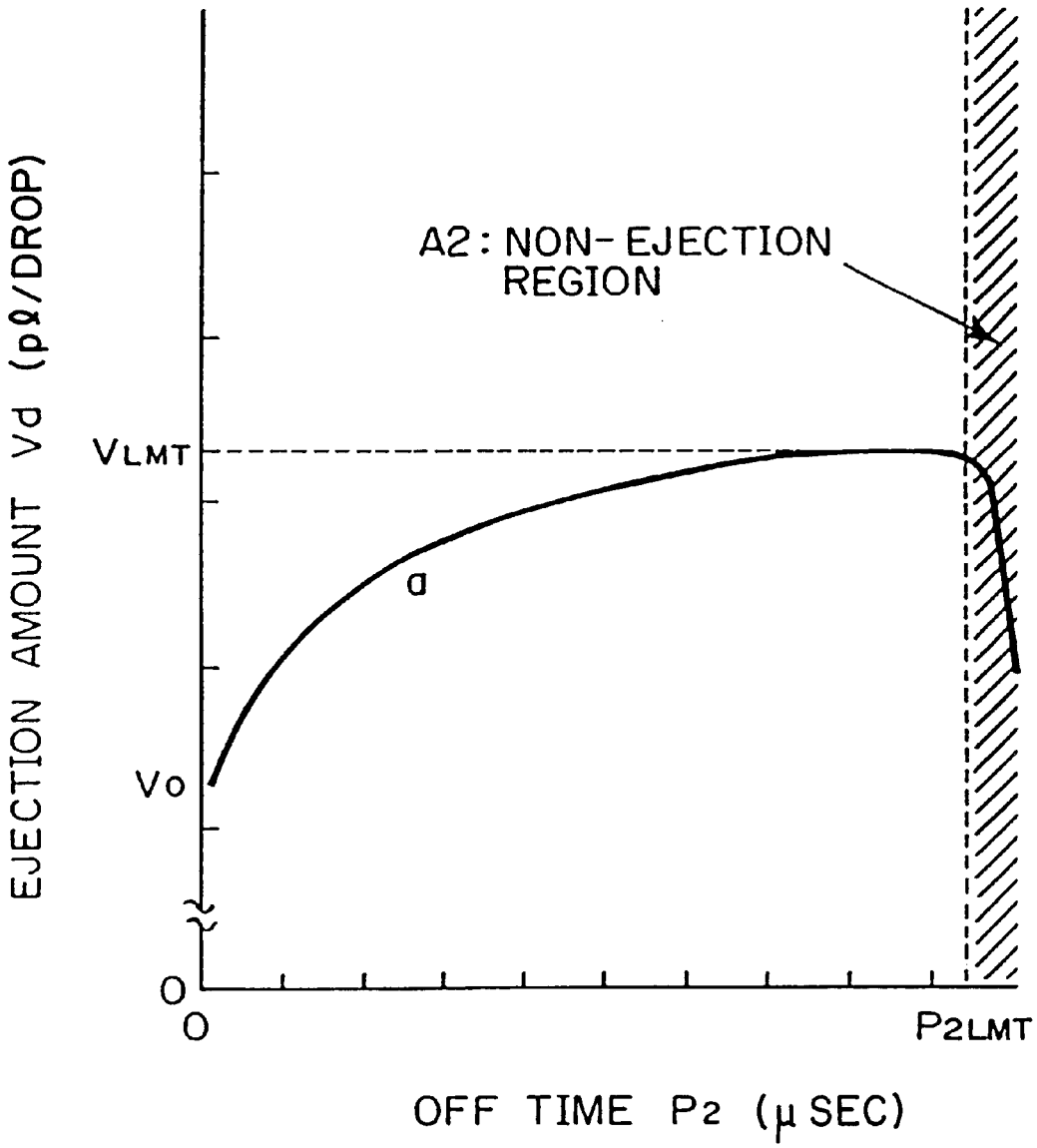
FIG. 20 is a chart showing an interval time dependency of the ejection amount in the third embodiment of the invention.

Variation of the ejection amount in the later control is illustrated in FIG. 20. According to increasing of the interval time, the ejection amount is increased and, at a certain timing, it enters into a region A2 where bubbling is not caused. In this driving method, increasing of temperature of the printing head becomes a serious problem. Typically, at the high temperature range, a single pulse with reduced pulse width is employed to reduce energy to be applied for restricting increase of the temperature. However, in case of the example of FIG. 20, in relation to increasing of the temperature, $(T_2-T_1)$ is increased and, from the timing where $(T_2-T_1)=0$ is established, $T_1$ is decreased to implement the foregoing control. Therefore, modulation can be done with maintaining continuity of the pulse waveform.

The shown embodiment may be adapted to either driving method by the following method. Also, the shown embodiment may be adapted to the driving method, in which both of the pre-pulse modulation driving method and the interval modulation driving method are present by the same method.

When ink temperature is low, there is a limitation in compensating necessary ejection amount to be increased by the PWM driving method with respect to shorting of the ejection amount under low temperature. Therefore, the ejection amount is increased by increasing the temperature of the ink by driving a temperature holding heater.

Figure 21:
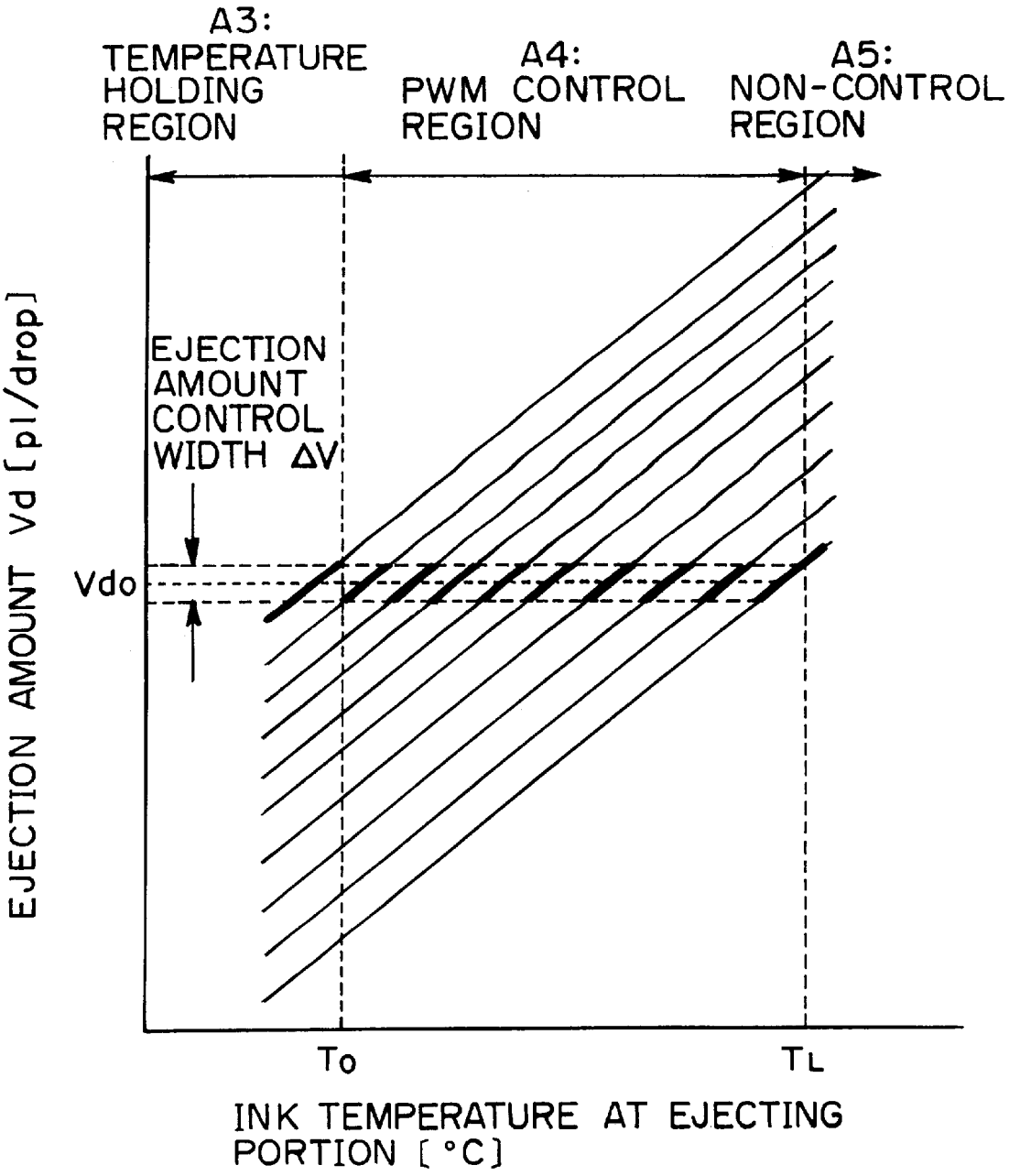
FIG. 21 is a chart showing an ejection amount control in the third embodiment of the invention.

The relationship set forth above is illustrated as a control chart in FIG. 21. In FIG. 21, when the ink temperature (printing head temperature) is lower than $T_0$, the printing head is heated by means of a sub-heater (region $A_3$). Accordingly, the PWM control as the ejection amount control depending upon the ink temperature is performed at the temperature higher than or equal to $T_0$. In FIG. 21, the temperature range indicated as PWM region $A_4$ is the temperature range, in which the ejection amount can be stabilized. In the shown embodiment, the ink temperature of the ejecting portion is in a range of 24~54° C. It should be noted that the region beyond the temperature $T_L$ is a non-control region $A_5$. In FIG. 21, the relationship of the ink temperature of the ejecting portion and the ejection amount is shown in the case where the pre-pulse is varied in 11 steps. Even when the ink temperature of the ejecting portion is varied, by varying the pulse width per the temperature step width T depending upon the ink temperature, with the width of V relative to the target ejection amount $V_{do}$, ejection amount can be controlled.

Hereinafter, a printing head drive table by the interval time control of 15 steps is shown.

TABLE 12

| Ink Temperature | $P_1$ | $P_2$ | $P_3$ |
|---|---|---|---|
| ~4° C. | 1.45 μsec. | 2.90 μsec. | 3.08 μsec. |
| ~6° C. | 1.45 μsec. | 2.72 μsec. | 3.08 μsec. |
| ~8° C. | 1.45 μsec. | 2.53 μsec. | 3.08 μsec. |
| ~10° C. | 1.45 μsec. | 2.35 μsec. | 3.08 μsec. |
| ~12° C. | 1.45 μsec. | 2.17 μsec. | 3.08 μsec. |
| ~14° C. | 1.45 μsec. | 1.99 μsec. | 3.08 μsec. |
| ~16° C. | 1.45 μsec. | 1.81 μsec. | 3.08 μsec. |
| ~18° C. | 1.45 μsec. | 1.63 μsec. | 3.08 μsec. |
| ~20° C. | 1.45 μsec. | 1.44 μsec. | 3.08 μsec. |
| ~22° C. | 1.45 μsec. | 1.09 μsec. | 3.08 μsec. |
| ~24° C. | 1.45 μsec. | 0.72 μsec. | 3.08 μsec. |
| ~26° C. | 1.45 μsec. | 0.36 μsec. | 3.08 μsec. |
| ~28° C. | 1.45 μsec. | 0.18 μsec. | 3.08 μsec. |
| ~30° C. | 1.45 μsec. | 0.00 μsec. | 3.08 μsec. |
| ~30° C. | 1.26 μsec. | 0.00 μsec. | 3.08 μsec. |

As set forth above, as the printing parameter, there are the drive pulse data to be applied to the electrothermal transducer element and the pulse drive conditions applied to the sub-heater, such as $P_1$, $P_2$, $P_3$ or the like in relation to the ink temperature of the printing head.

In addition, as driving of the printing head, there is ink ejection other than that during printing. These are mainly performed for stable ejection of the printing head. Such non printing ejection includes the preliminary-ejection to be performed after wiping of the face of the printing head by the cleaning blade set forth above, flushing ejection to be performed for the purpose of intimacy of the ink with the orifices and heater of the printing head. It has been well known that the above-mentioned ejecting condition is closely associated with the characteristics of the printing head and the printing ink. Therefore, the conditions other than those during printing, are important as the printing parameter.

Resetting of Driving Pulse Data of Printing Head

By the construction as set forth above, the drive pulse data of the printing head is preliminarily set. However, when the printing head and the printing ink as the consumables are significantly improved and thus the optimal drive pulse data is varied, optimal drive condition cannot be obtained, and shortening of the life of the printing head, and degradation of the printed image is brought. With respect to this, in the shown embodiment, it becomes possible to modify the drive pulse data to the optimal data directly adopted to the improvement of the consumables.

Figure 22:
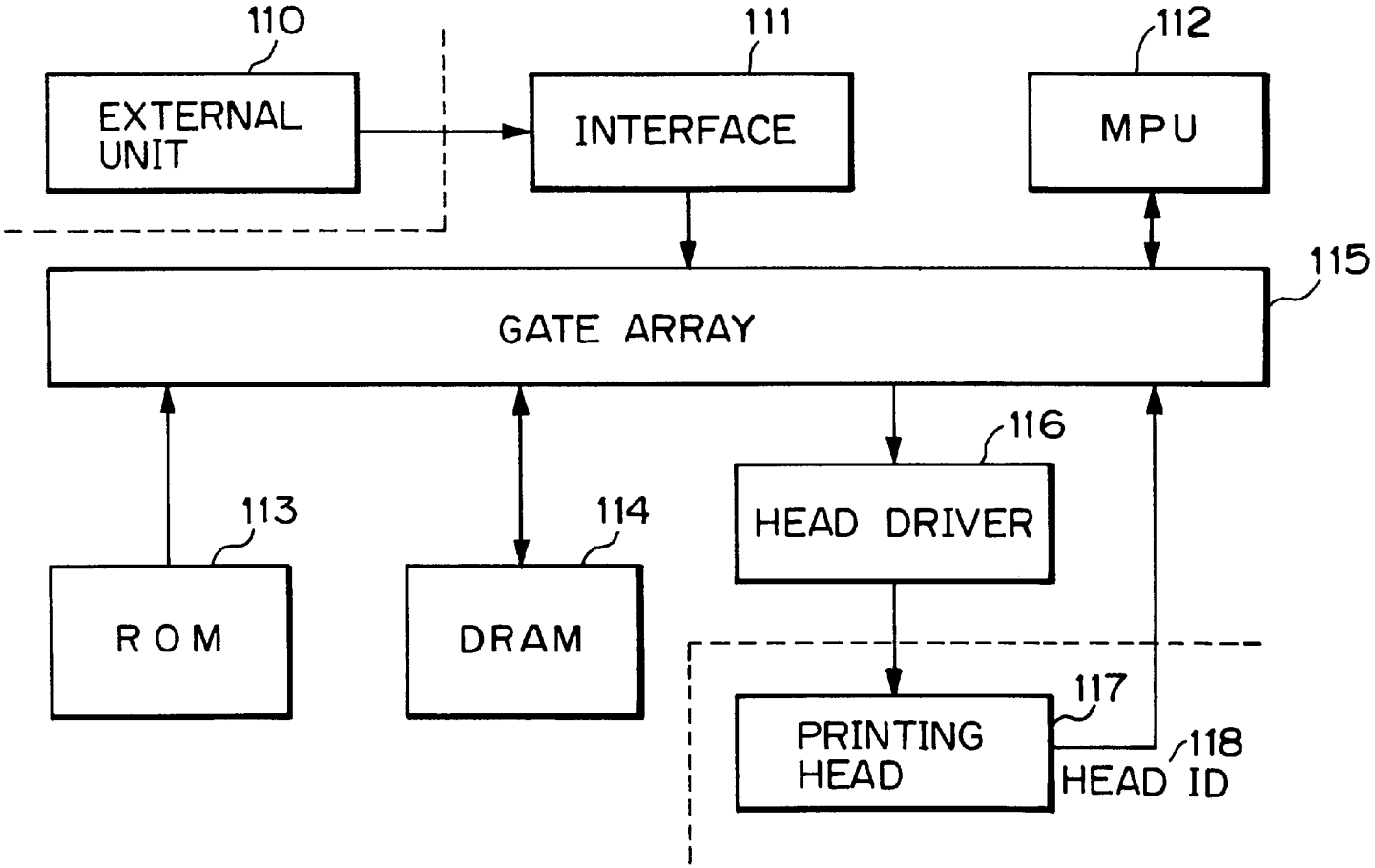
FIG. 22 is a block diagram showing a system of the third embodiment of the present invention.

FIG. 22 is a block diagram showing a construction of the control system in the printing apparatus in the shown embodiment.

As shown in FIG. 22, the shown embodiment of the printing apparatus includes an interface 111 for inputting the printing signal or drive pulse data from the external unit 110, a microprocessor unit (MPU) 112, a program ROM storing control programs to be executed by the MPU 112, a dynamic type random-access-memory (RAM) for storing various data (the printing signal, the printing parameter employed for driving the printing head, the printing data to be supplied to the head and so forth), a gate array 115 and a head driver 116. The gate array 115 performs supply control of the printing data for the printing head cartridge 117. The gate array 115 also performs transfer control of data between the interface 111, the MPU 112 and the RAM 114. The head driver 116 is adapted to drive the printing head 117. Also, as a primary component of the control portion, there are not shown motor drivers for driving the carrier motor for transporting the printing head and for driving the transporting motors for feeding the paper for printing. It should be noted that the printing head 117 is provided a head ID 118 for making the printing apparatus recognized the version of the printing head.

Figure 23:
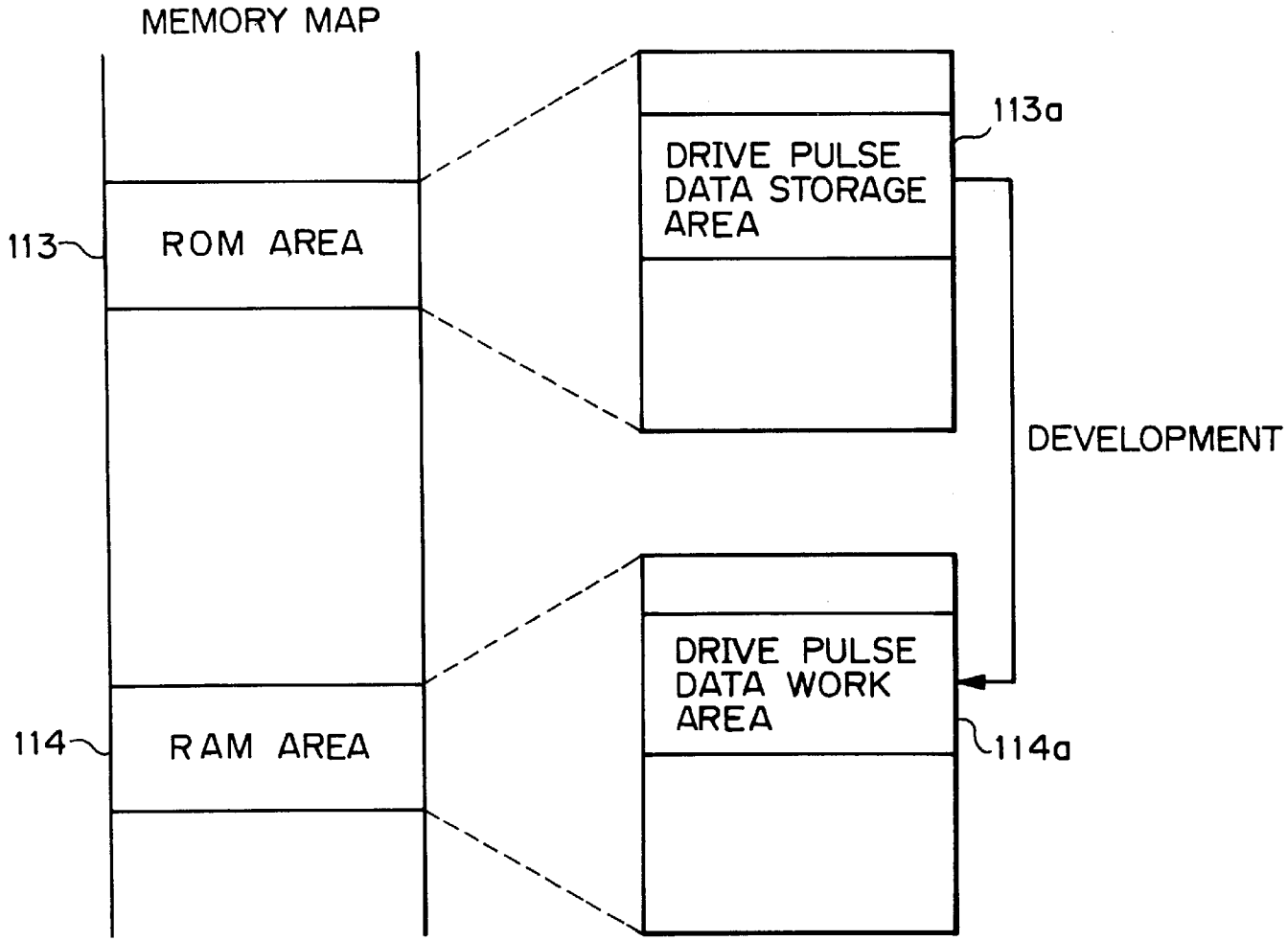
FIG. 23 is a illustration showing a construction of a memory shown in FIG. 22.

FIG. 23 is an extract of a memory map showing a memory construction in the shown embodiment. As can be clear from FIG. 23, in a drive pulse data storage area 113*a* of ROM region 113, the head drive pulse data adapted to the printing head and printing ink employed at the time of shipping of the product is stored in the form shown in the table 12. The control portion is responsive to turning ON of the power source of the printing apparatus to copy the head drive pulse data stored in the ROM 113 to a drive pulse data work area 114*a* of the RAM 114. Subsequently, the control portion performs control for driving the printing head 117 by making reference to the head drive pulse data stored in the head drive pulse work area 114*a* of the RAM 114.

On the other hand, in the shown embodiment of the printing apparatus, a command is provided for permitting down-load input of the head drive pulse data from the external unit to the RAM 114 through the interface 111.

Namely, by transferring data according to a rule standardized by the command, the printing apparatus has a specification, in which the data in the head drive pulse data work area 114*a* of the RAM 114 can be freely re-written. By supplying a medium for updating the content of the head drive pulse data work area 114*a* with the optimal value with the head drive parameter modification command employing this specification, the printing head can be optimally driven even when the printing head 117 or the printing ink as the consumables are improved.

Furthermore, it is desirable that the shown embodiment of the printing apparatus is provided with means for recognizing the version (e.g. the head ID 118) of the printing head cartridge 117, data indicative of the version of the printing head adaptable to the foregoing recognition is added to the command for setting the drive pulse data, and the printing apparatus rewrite the content of RAM 114 with the printing head drive pulse data with that corresponding to the version of the printing head.

It should be noted that there is no special limitation for the medium as long as the medium has the specification which can transfer to the control portion of the printing apparatus of the data via the interface 111. For instance, it can be a floppy disk corresponding to a disk drive of the personal computer storing data in a form of a file, and can be a part of element of the printer driver.

As set forth above, in case of the shown embodiment, it becomes possible to realize the control system of the ink-jet printing apparatus which permits product strategy significantly improving compatability of the products by version up of the consumables, which is the most important feature of the ink-jet printing apparatus.

Furthermore, it is clear that the present invention is applicable for printing systems other than the thermal ink-jet system as long as the printing apparatus performing printing by driving printing elements by drive pulses. Since this fact is obvious to those skilled in the art, detailed discussion is neglected to keep disclosure simple enough to facilitate clear understanding of the invention.

(Fourth Embodiment)

Next, discussion will be given for another embodiment of updating of the drive pulse data of the printing head by the external unit.

Figure 24:
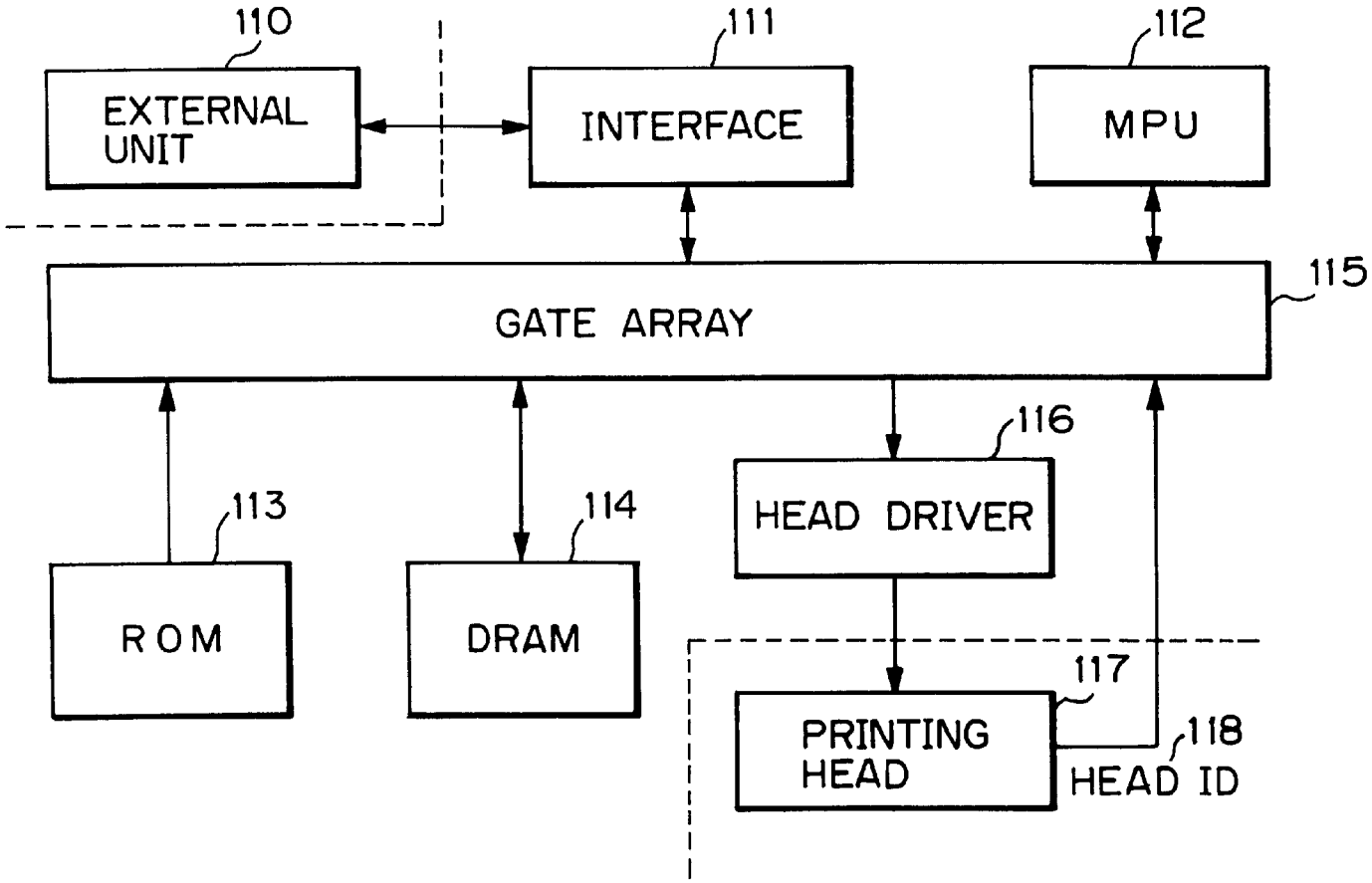
FIG. 24 is a block diagram showing a system of the fourth embodiment of the present invention.

FIG. 24 is a block diagram showing the construction of the shown embodiment. The foregoing third embodiment employs one-way communication from the external unit 110 to the printing apparatus. In contrast to this, the shown embodiment permits bidirectional communication between the external unit 110 and the printing apparatus.

The shown system, similarly to the former embodiment, reads out the head ID indicative of the version of the printing head cartridge 117 by the printing apparatus, transfers the version data to the external unit 110 via the interface 111 of the printing apparatus, transfers the drive pulse data adapted to the version in the external unit 110 to the interface 111 of the printing apparatus and performs similar operation to the former embodiment in the printing apparatus.

On the other hand, by comparing the version of the printing head cartridge 117 and the version of the drive parameter stored in the RAM 114, if the drive pulse data is modified, a signal requiring updating of the drive pulse data and the version of the printing head cartridge 117 may be fed to the external unit 110 and the drive parameter corresponding to the version of the printing head cartridge 117 may be transmitted to the printing apparatus.

By the shown system, it becomes unnecessary to add the data indicative of version of the adaptable printing head in the parameter updating command as in the former embodiment, and without transmitting the drive parameter of the all version to all printing apparatus, only necessary version of drive parameter can be transferred to permit shortening data transfer period.

(Fifth Embodiment)

Figure 25:
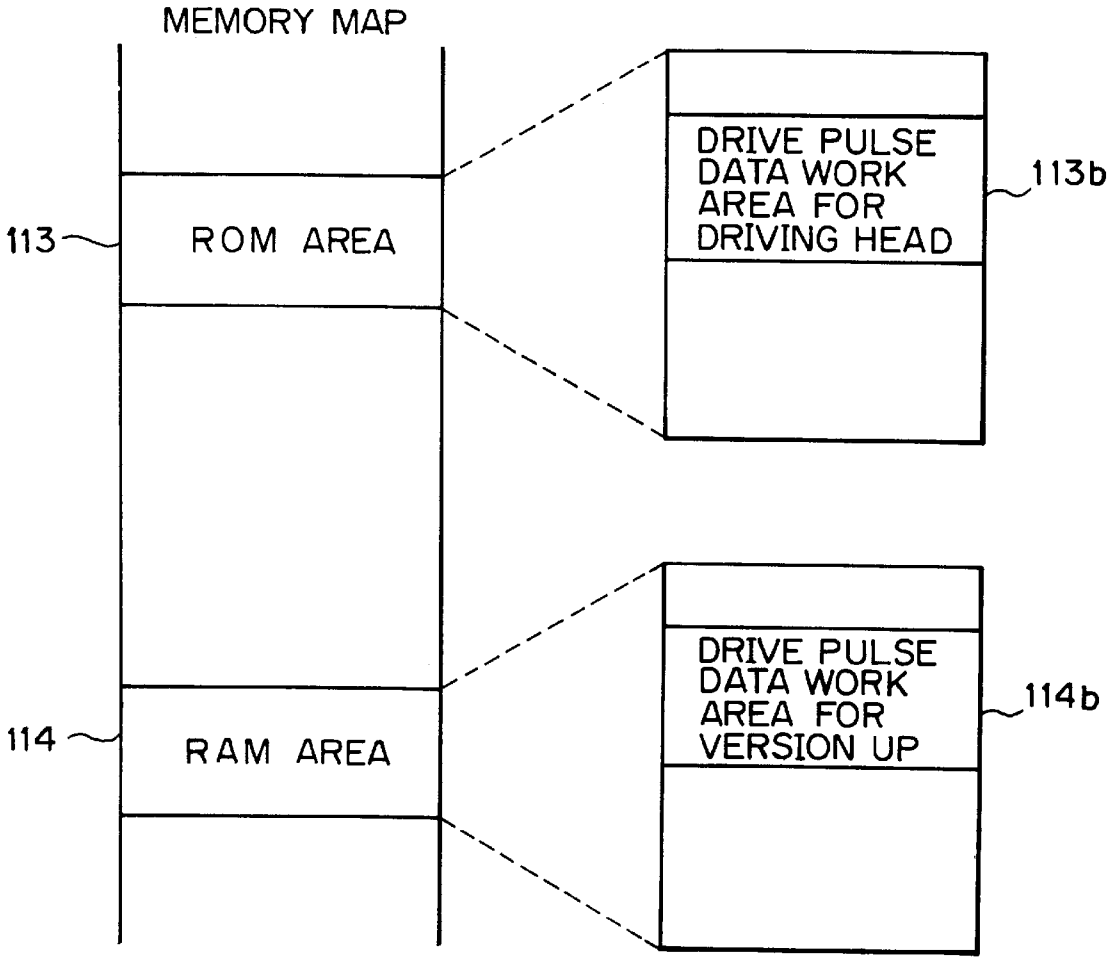
FIG. 25 is an illustration showing a construction of the memory in the fifth embodiment of the invention.

Next, a further embodiment for updating the drive pulse data of the printing head by the external unit will be discussed with reference to FIG. 25.

The above-mentioned embodiment, upon version up of the printing head, for developing all or part of the drive pulse data required modification in the work area 114*a* of the RAM 114, a part of capacity of the RAM is always occupied.

Therefore, with reference to the head ID 118 of the printing head cartridge 117 in the shown embodiment, when new drive parameter is necessary, with using only necessary capacity of the drive pulse work area 114*b* in the RAM 114 for version up, the printing head 117 is driven. When updating of the drive parameter is unnecessary, the buffer to the work area is released as buffer for the printing data.

Furthermore, the printing apparatus takes the construction, in which only newly required drive parameter is written in by providing the necessary capacity of work area in the RAM 114 of the printing apparatus, the written drive parameter is preferentially used than the drive pulse data in the driver pulse data area 113*b* of the drive head of the ROM 113.

With this system, instead of unnecessarily providing the RAM in the driving pulse data which can be updated, updating of any drive pulse data becomes possible with occupying minimum memory area.

It should be noted that in the embodiments set forth above, ROM which is used for preliminarily storing the printing parameter is provided in a main body of the printing apparatus. It, however, is not always necessary to provide such memory in the apparatus. In stead of providing memory, a construction in which the printing parameter is previously input from the external apparatus, may be employed.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus for performing printing by applying a drive pulse to a printing element of a printing head, said apparatus comprising:

drive pulse setting means for setting the drive pulse by making reference to a driving parameter;

memory means in which the driving parameter referenced by said drive pulse setting means is preliminarily set;

interface means for receiving a print signal and at least a part of the driving parameter from an external apparatus; and updated memory means in which the driving parameter received by said interface means is set, wherein said drive pulse setting means preferentially makes reference to the driving parameter set in said updated memory means over the driving parameter set in said memory means.

2. A printing apparatus as claimed in claim 1, further comprising identifying means for identifying a kind of the printing head by making discrimination of identification information of the printing head indicative of the kind of the printing head, and wherein when at least a part of the driving parameter is received from the external apparatus, only the driving parameter corresponding to the kind of the printing head identified by said identifying means is set in said updated memory means.

3. A printing apparatus as claimed in claim 2, wherein said interface means has a function for outputting the identification information indicative of the kind of the printing head.

4. A printing apparatus as claimed in claim 1, wherein the printing head causes state change in ink by thermal energy and ejects the ink based on the state change.

5. A printing apparatus as claimed in claim 1, further comprising transport means for transporting a printing medium.

6. A printing apparatus as claimed in claim 1, further comprising a carriage for mounting the printing head so as to move the printing head.

7. A printing apparatus as claimed in claim 1, further comprising information transmitting and receiving means for transmitting and receiving information, wherein received information is printed by the printing head.

8. A printing apparatus as claimed in claim 1, further comprising information reading means for reading information, wherein read information is printed by the printing head.

9. A printing apparatus as claimed in claim 1, further comprising information key input means for key inputting information, wherein key input information is printed by the printing head.

10. A printing method for performing printing by applying a drive pulse to a printing element of a printing head, said method comprising the steps of:

receiving a print signal and at least a part of the driving parameter from an external apparatus through interface means;

setting the driving parameter received through the interface means in updated memory means, separately from a driving parameter preliminarily set in memory means; and preferentially making reference to the driving parameter set in said updated, memory means over the driving parameter set in said memory means.

11. A printing method as claimed in claim 10, further comprising the step of identifying a kind of the printing head by making discrimination of identification information of the printing head indicative of the kind of the printing head, and wherein when at least a part of the driving parameter is received from the external apparatus, only the driving parameter corresponding to the kind of the printing head identified in said identifying step is set in the updated memory means.

12. A printing method as claimed in claim 11, wherein the interface means has a function of outputting the identification information indicative of the kind of the printing head.

13. A system comprising:

a printing apparatus for performing printing by applying a drive pulse to a printing element of a printing head, said printing apparatus including drive pulse setting means for setting the drive pulse by making reference to a driving parameter, memory means in which the driving parameter to be referenced by said drive pulse setting means is preliminarily set, interface means for receiving a print signal and at least a part of the driving parameter from an external apparatus, and updated memory means in which the driving parameter received by said interface means is set, wherein said drive pulse setting means preferentially makes reference to the driving parameter set in said updated memory means over the driving parameter set in said memory means; and an external apparatus sending the printing data and the printing parameter to said interface means.

14. A system as claimed in claim 13, wherein said external apparatus is a host computer.

* * * * *

UNITED STATES PATENT AND TRADEMARK OFFICE

CERTIFICATE OF CORRECTION

PATENT NO. : 6,394,571 B1
DATED : May 28, 2002
INVENTOR(S) : Yano et al.

It is certified that error appears in the above-identified patent and that said Letters Patent is hereby corrected as shown below:

Title page,
Item [56], References Cited, U.S. PATENT DOCUMENTS:
"4,872,027 A * 10/1989 Buskird et al." should read
-- 4,872,027 A * 10/1989 Buskirk et al. --.

Item [56], References Cited, FOREIGN PATENT DOCUMENTS:
"54056847
59123670
59138461
60071260" should read
-- 54-56847
59-123670
59-138461
60-71260 --.
"5208505" should read -- 5-208505 --.

Column 1,
Line 28, "a" should read -- an --.
Line 48, "have" should read -- has --.

Column 2,
Line 23, "respect" should read -- with respect --.

Column 3,
Line 18, "is" should be deleted.
Line 19, "use" should read -- uses --.
Line 32, "consumables," should read -- a consumable, --.

Column 5,
Line 55, "to unnecessary" should read -- not to unnecessarily --.
Line 57, "respective of" should read -- respectively --.

Column 6,
Line 65, "late" should read -- plate --.

UNITED STATES PATENT AND TRADEMARK OFFICE

CERTIFICATE OF CORRECTION

PATENT NO. : 6,394,571 B1
DATED : May 28, 2002
INVENTOR(S) : Yano et al.

It is certified that error appears in the above-identified patent and that said Letters Patent is hereby corrected as shown below:

Column 7,
Line 55, "formed" should read -- be formed --.

Column 8,
Line 13, "fir" should read -- for --.
Line 61, "provided" should read -- providing --.
Line 67, "surface of the" (second occurrence) should be deleted.

Column 12,
Line 33, "reflects" should read -- reflect --.

Column 14,
Line 46, "cam" should read -- can --.

Column 15,
Line 14, "handles" should read -- handled --.

Column 18,
Line 44, "cause" should read -- caused --.

Column 19,
Line 5, "Me" should read -- se --.
Line 18, "neglected." should read -- omitted. --.
Line 26, "similarly" should read -- similar --.
Line 67, "suction." should read -- suction are related. --.

Column 20,
Line 20, "for" should be deleted.
Line 25, "other. Therefore," should read -- other, --.

Column 21,
Line 1, "is" (second occurrence) should be deleted.

UNITED STATES PATENT AND TRADEMARK OFFICE

CERTIFICATE OF CORRECTION

PATENT NO. : 6,394,571 B1
DATED : May 28, 2002
INVENTOR(S) : Yano et al.

It is certified that error appears in the above-identified patent and that said Letters Patent is hereby corrected as shown below:

Column 24,
Line 61, "similarly" should read -- similar --.

Column 25,
Line 53, "by" should be deleted.
Line 55, "to" should be deleted.
Line 56, "increase" should read -- increases --.

Column 29,
Line 35, "non" should read -- non- --.

Column 31,
Line 12, "similarly" should read -- similar --.
Line 64, "In stead" should read -- Instead --.

Column 32,
Line 55, "consists" should read -- consist --.

Column 33,
Line 40, "air," should read -- the air, --.

Signed and Sealed this

Twenty-eighth Day of January, 2003

JAMES E. ROGAN
*Director of the United States Patent and Trademark Office*